US007305946B2

(12) United States Patent
Nakamura et al.

(10) Patent No.: US 7,305,946 B2
(45) Date of Patent: Dec. 11, 2007

(54) VARIABLE VALVE OPERATING APPARATUS FOR INTERNAL COMBUSTION ENGINE

(75) Inventors: Makoto Nakamura, Kanagawa (JP); Seinosuke Hara, Kanagawa (JP)

(73) Assignee: Hitachi, Ltd., Tokyo (JP)

( * ) Notice: Subject to any disclaimer, the term of this patent is extended or adjusted under 35 U.S.C. 154(b) by 56 days.

(21) Appl. No.: 11/248,150

(22) Filed: Oct. 13, 2005

(65) Prior Publication Data

US 2006/0112917 A1 Jun. 1, 2006

(30) Foreign Application Priority Data

Nov. 30, 2004 (JP) ..... 2004-345069
Jan. 26, 2005 (JP) ..... 2005-017719

(51) Int. Cl.
*F01L 1/34* (2006.01)

(52) U.S. Cl. ..... 123/90.16; 123/90.15; 123/90.17; 123/90.31

(58) Field of Classification Search ..... 123/90.16
See application file for complete search history.

(56) References Cited

U.S. PATENT DOCUMENTS 6,311,659 B1 * 11/2001 Pierik ..... 123/90.24
6,378,474 B1 * 4/2002 Pierik ..... 123/90.16
6,382,151 B2 * 5/2002 Pierik ..... 123/90.16
2004/0231625 A1 11/2004 Sugiura et al.

FOREIGN PATENT DOCUMENTS

JP 2002-371816 A 12/2002

* cited by examiner

*Primary Examiner*—Thomas Denion
*Assistant Examiner*—Kyle M. Riddle
(74) *Attorney, Agent, or Firm*—Foley & Lardner LLP

(57) ABSTRACT

A variable valve operating apparatus including a drive cam, a rocker cam pivotally supported on a first pivot, a lift varying mechanism operative to change a pivotal position of the rocker cam to vary a valve lift of an engine valve, a swing arm including one end portion at which the swing arm is pivotally supported on a second pivot and the other end portion contacted with the engine valve, a hollow space defined between the end portions of the swing arm, and a driven roller rotatably disposed within the hollow space of the swing arm and contacted with a cam surface of the rocker cam. When the valve lift of the engine valve is a predetermined lift amount or more, a contact point between the driven roller and the rocker cam is located in the hollow space of the swing arm.

20 Claims, 20 Drawing Sheets

VARIABLE VALVE OPERATING APPARATUS FOR INTERNAL COMBUSTION ENGINE

BACKGROUND OF THE INVENTION

The present invention relates to an improvement of a variable valve operating apparatus for an internal combustion engine which variably controls the lift and open duration of engine valves, i.e., intake and/or exhaust valves, depending on engine operating conditions.

Japanese Patent Application First Publication No. 2002-371816 discloses a variable valve operating apparatus for an internal combustion engine, which includes a bifurcated rocker arm disposed above a cylinder head with two intake valves per cylinder. The rocker arm with a roller includes one end portion pivotal about a pivot and the other two branched end portions which are contacted with stem ends of the intake valves, respectively. A control shaft is rotatably disposed above the rocker arm. A first intervening arm is pivotally supported on the control shaft and drives the roller of the rocker arm. A second intervening arm is pivotally supported on a projecting portion integrally formed with the control shaft. A drive cam on a cam shaft urges the second intervening arm onto the first intervening arm to thereby cause the pivotal motion of the first intervening arm. By rotating the control shaft and the projecting portion in a relatively small angular range, the pivotal motion of the first intervening arm by the drive cam is controlled so that the lift and open duration of the intake valves through the rocker arm are varied.

SUMMARY OF THE INVENTION

Recently, downsizing of a valve operating apparatus for an internal combustion engine of a vehicle has been demanded in order to enhance the installability into an engine room of the vehicle. For the purpose of satisfying the demand, there has been proposed an arrangement of the valve operating apparatus in which the valve operating apparatus is located in an intake-side position closer to an intake valve.

However, in the variable valve operating apparatus with such a mechanism for varying the valve lift and open duration as described in the above conventional art, if the mechanism is arranged in the intake-side position, a sufficient lift amount of the intake valve cannot be ensured.

It is an object of the present invention to solve the above-described problems in the technology of the conventional art and to provide a variable valve operating apparatus for an internal combustion engine, which is capable of providing high lift of engine valves and downsizing the apparatus.

The other objects and features of this invention will become understood from the following description with reference to the accompanying drawings.

In one aspect of the present invention, there is provided a variable valve operating apparatus for variably operating an engine valve of an internal combustion engine, the variable valve operating apparatus comprising:

a drive cam configured to receive input torque from a crankshaft of the engine;

a rocker cam pivotally supported on a first pivot;

a lift varying mechanism operative to change a pivotal position of the rocker cam to vary a valve lift of the engine valve, while transmitting the input torque from the drive cam to the rocker cam;

a swing arm including one end portion at which the swing arm is pivotally supported on a second pivot and the other end portion contacted with the engine valve;

a hollow space defined between the one end portion of the swing arm and the other end portion thereof; and a driven roller rotatably disposed within the hollow space of the swing arm and contacted with a cam surface of the rocker cam, wherein when the valve lift of the engine valve is a predetermined lift amount or more, a contact point between the driven roller and the rocker cam is located in the hollow space of the swing arm.

In a further aspect of the invention, there is provided a variable valve operating apparatus for variably operating an engine valve of an internal combustion engine, the variable valve operating apparatus comprising:

a drive cam configured to receive input torque from a crankshaft of the engine;

a swing arm including one end portion at which the swing arm is pivotally supported on a first pivot and the other end portion contacted with the engine valve;

a hollow space defined between the one end portion of the swing arm and the other end portion thereof;

a rocker cam pivotally supported on a second pivot such that a cam nose thereof is located in the hollow space when the valve lift of the engine valve is a predetermined lift amount or more;

a lift varying mechanism operative to change a pivotal position of the rocker cam to vary a valve lift of the engine valve, while transmitting the input torque from the drive cam to the rocker cam; and a driven roller rotatably disposed within the hollow space in the swing arm and contacted with a cam surface of the rocker cam.

In a still further aspect of the invention, there is provided a variable valve operating apparatus for variably operating an engine valve of an internal combustion engine, the variable valve operating apparatus comprising:

a drive cam configured to receive input torque from a crankshaft of the engine;

a rocker cam pivotally supported on a first pivot, the rocker cam having two surfaces opposed to each other in a direction of the pivotal motion of the rocker cam;

a rocker member converting a rotational motion of the drive cam to a pivotal motion;

a first motion transmission member transmitting the pivotal motion of the rocker member to the rocker cam, the first motion transmission member being rotatably disposed on the rocker member and contacted with one of the two surfaces of the rocker cam;

a control section for varying the pivotal motion of the rocker member to vary lift of the engine valve;

a swing arm including one end portion at which the swing arm is pivotally supported on a second pivot and the other end portion contacted with the engine valve; and a second motion transmission member transmitting the pivotal motion of the rocker cam to the engine valve, the second motion transmission member being rotatably disposed on the swing arm and contacted with the other of the two surfaces of the rocker cam.

DETAILED DESCRIPTION OF THE INVENTION

Figure 1:
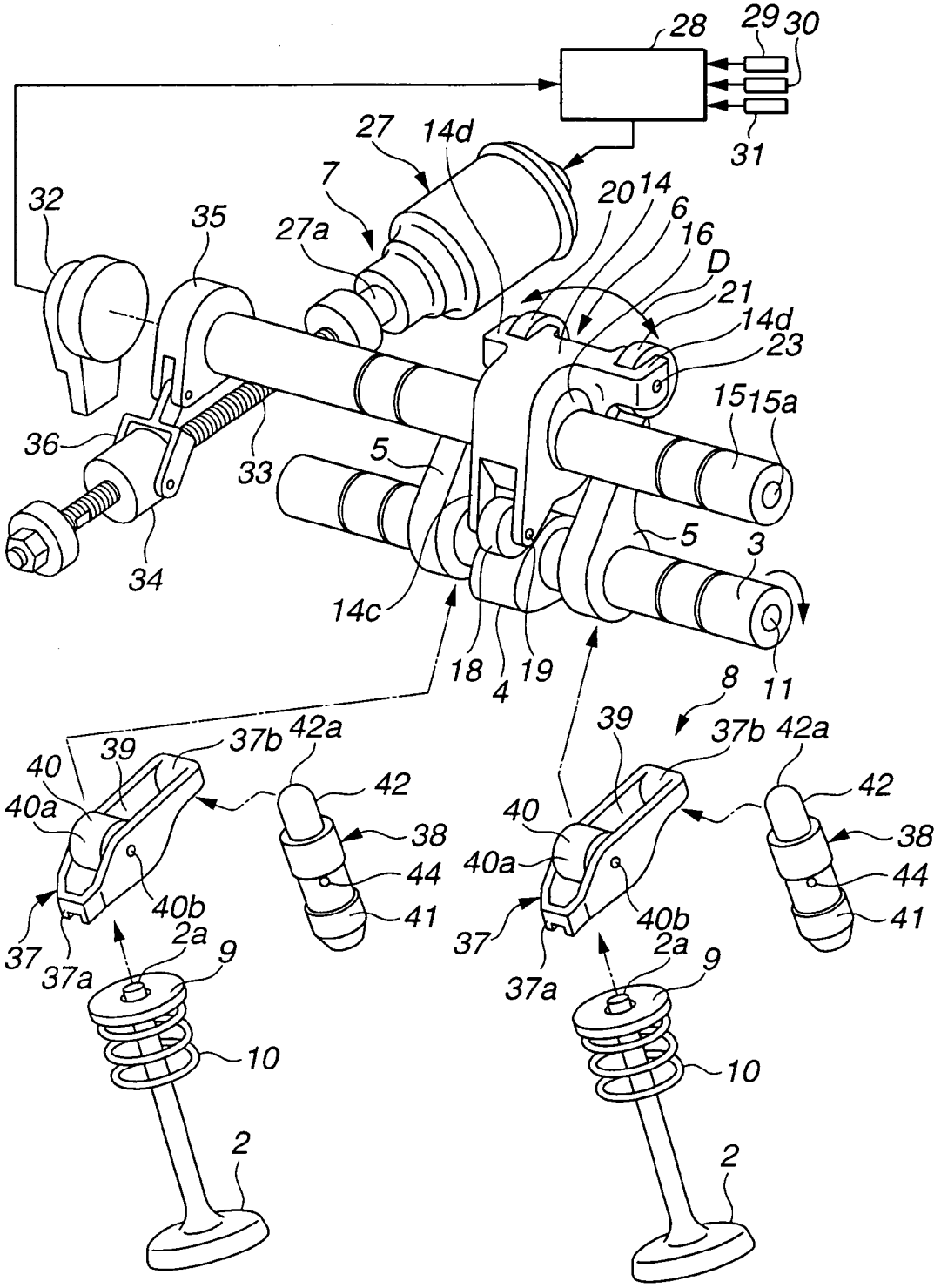
FIG. 1 is an exploded perspective view of a first embodiment of a variable valve operating apparatus according to the present invention.
Figure 2:
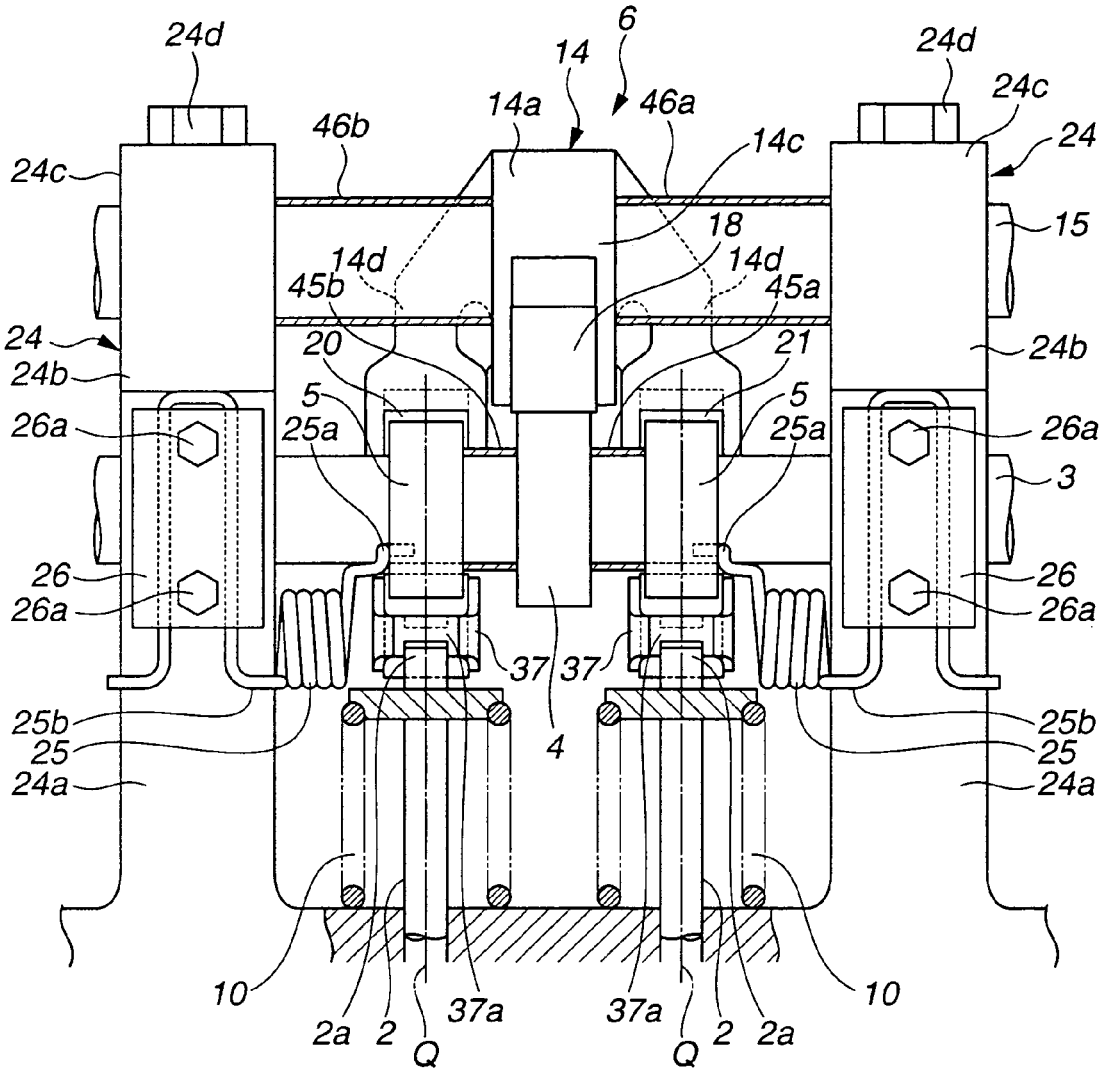
FIG. 2 is a side view of an essential part of the variable valve operating apparatus as shown in FIG. 1.
Figure 3:
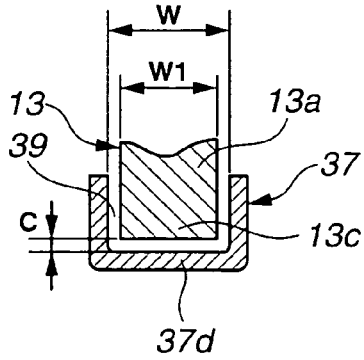
FIG. 3 is a sectional view taken along line A-A of FIG. 7.
Figure 4:
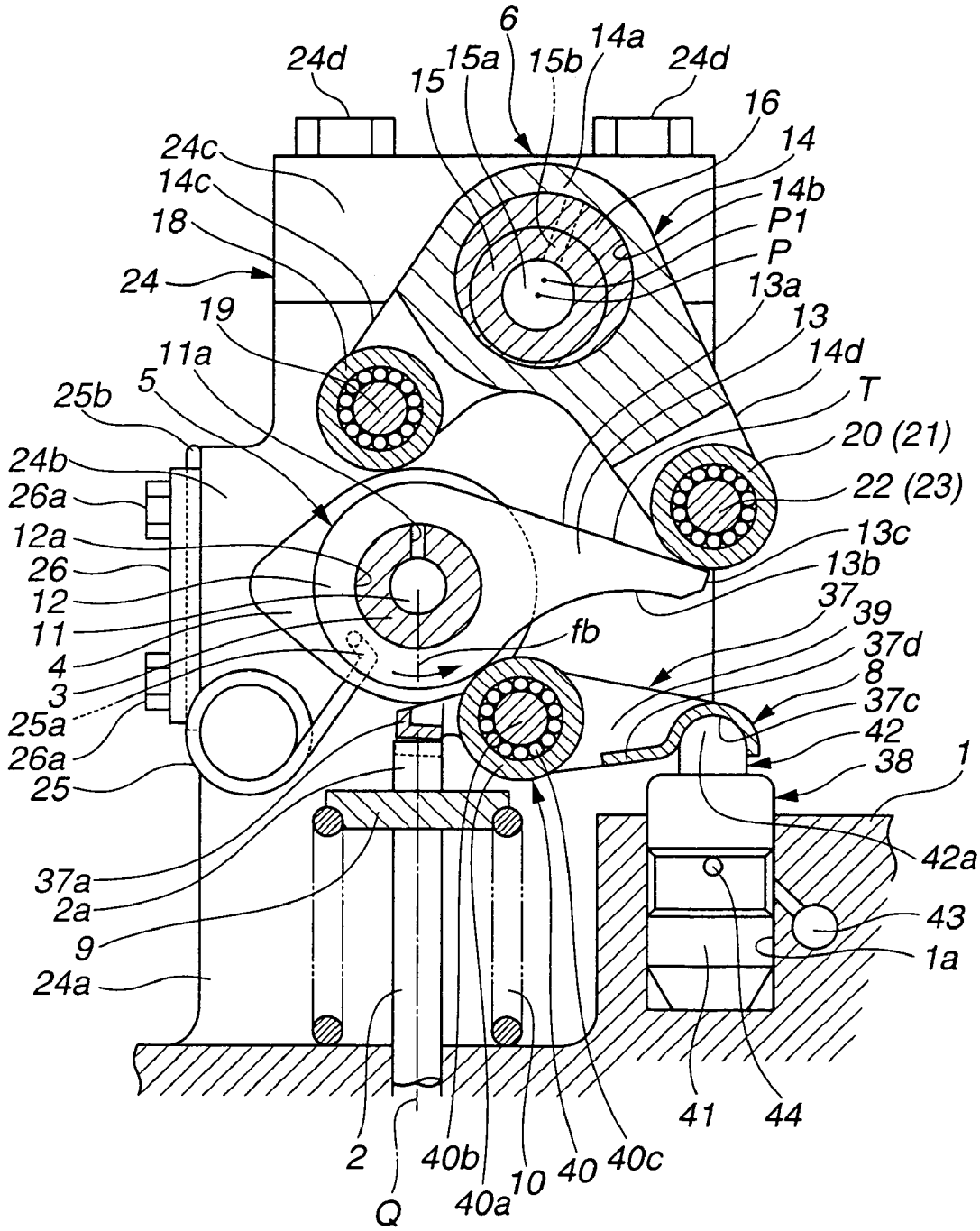
FIGS. 4 and 5 are vertical cross-sections of the first embodiment of the variable valve operating apparatus, showing an operation of minimum lift control of an intake valve.

Referring now to FIGS. 1-8, a first embodiment of a variable valve operating apparatus for an internal combustion engine according to the present invention, is explained. In this embodiment, the variable valve operating apparatus is used on an intake side of the engine with two intake valves per cylinder. As illustrated in FIGS. 1, 2 and 4, the variable valve operating apparatus includes two intake valves 2, 2 slidably mounted on cylinder head 1 through valve guides, not shown, drive shaft 3 disposed above cylinder head 1 and rotatively driven by a crankshaft of the engine, drive cam 4 disposed on an outer circumferential surface of drive shaft 3, a pair of rocker cams 5, 5 operative to open and close intake valves 2, 2, lift varying mechanism 6 that mechanically links drive cam 4 to rocker cams 5, 5 to vary the lift of intake valves 2, 2, actuation mechanism 7 for actuating a control section of lift varying mechanism 6 which controls an operating position of lift varying mechanism 6, and swing mechanism 8 for transmitting the operating motion of lift varying mechanism 6 to intake valves 2, 2 via rocker cams 5, 5.

Each of intake valves 2, 2 has stem end 2*a* to which spring retainer 9 is fixed via a cotter. Intake valve 2 is biased by valve spring 10 having one end portion that is supported on spring retainer 9, in such a direction that intake valve 2 be in a closed position.

Drive shaft 3 extends in a fore-and-aft direction of the engine and receives input torque from the crankshaft through a driven sprocket, not shown, that is mounted to one end portion of drive shaft 3, and a timing chain, not shown, that is wound on the driven sprocket. Drive shaft 3 rotates in a clockwise direction as indicated by the arrow in FIG. 1. Drive shaft 3 is formed with axial oil passage 11 axially extending inside drive shaft 3 and communicating an oil gallery, not shown, that is formed in cylinder head 1.

Single drive cam 4 is provided per cylinder. Drive cam 4 is integrally formed with drive shaft 3 and has a generally raindrop shape as shown in FIG. 4. Drive cam 4 includes a base-circle portion integrally formed with drive shaft 3. Drive cam 4 has a rotation axis, i.e., a rotation axis of drive shaft 3 which extends in the base-circle portion and substantially perpendicular to a direction of axis Q of respective intake valves 2, 2. Drive cam 4 is placed in an upward position upwardly spaced from axis Q of intake valves 2, 2, and disposed between intake valves 2, 2 as shown in FIG. 2.

Two rocker cams 5, 5 are disposed on drive shaft 3 such that drive cam 4 is disposed between rocker cams 5, 5. Rocker cams 5, 5 are pivotally supported on drive shaft 3 as a pivot of the pivotal motion of rocker cam 5. As shown in FIG. 4, each of rocker cams 5, 5 includes generally annular base portion 12 pivotally supported on the outer circumferential surface of drive shaft 3, and cam lobe 13 substantially radially extending from an outer surface of base portion 12. Base portion 12 is formed with central bore 12*a* axially extending through base portion 12. Base portion 12 is fitted onto the outer circumferential surface of drive shaft 3 and slidably rotated thereon. Lubricating oil is supplied to between the outer circumferential surface of drive shaft 3 and an inner circumferential surface of base portion 12 which defines central bore 12*a*, via radial oil hole 11*a* radially extending through drive shaft 3 and communicating axial oil passage 11. Cam lobe 13 is tapered toward a tip end portion thereof, that is, cam nose 13*c*. As shown in FIG. 4, rocker cam 5 includes planar contact surface 13*a* extending on an upper side of cam lobe 13, and cam surface 13*b* extending from the side of base portion 12 to the side of cam nose 13*c* along a lower side of cam lobe 13. Contact surface 13*a* and cam surface 13*b* are located in an opposed relation to each other with respect to a direction of the pivotal motion of rocker cam 5. Cam surface 13*b* is formed into a substantially arcuate-curved surface and includes a part of a base-circle surface of base portion 12, a ramp surface continuously extending from the base-circle surface of base portion 12 toward the tip end portion of cam nose 13*c*, a maximum-lift surface near cam nose 13*c* and a small-lift surface extending between the ramp surface and the maximum-lift surface. The maximum-lift surface and the small-lift surface are configured to provide a maximum lift of intake valves 2, 2 and a relatively small lift thereof, respectively, as explained later.

Lift varying mechanism 6 is constituted of a rocker section including rocker arm 14 and acting for converting a rotational motion, i.e., the input torque of drive cam 4 to a pivotal motion of rocker arm 14, a motion transmission section for transmitting the pivotal motion rocker arm 14 to rocker cam 5, and a control section for altering the pivotal position of rocker arm 14 to vary the lift of intake valves 2, 2. Specifically, rocker arm 14 mechanically links drive cam 4 to rocker cam 5 to convert the rotational motion of drive cam 4 to the pivotal motion of rocker arm 14. Rocker arm 14 is formed into a substantially symmetrical-branched shape with respect to a center line thereof extending perpendicular to a pivot axis thereof in plan view. In this embodiment, rocker arm 14 has a generally Y-shape in plan view. Rocker arm 14 is bent to form a generally L-shape as seen from FIGS. 1 and 4. Specifically, rocker arm 14 includes base portion 14*a* formed with support through-bore 14*b* into which eccentric control cam 16 is fitted and pivotally supported. Rocker arm 14 further includes one end portion 14*c* projecting from base portion 14*a* toward drive cam 4, and the other end portion bifurcated into two end portions 14*d*, 14*d* and projecting from base portion 14*a* toward contact surface 13*a* of rocker cam 5. One end portion 14*c* and the other bifurcated end portions 14*d*, 14*d* have slit-shaped grooves at distal end portions thereof, respectively, as shown in FIG. 1.

The motion transmission section includes roller 18 rotatably supported on shaft 19 in the groove of one end portion 14*c* through a ball bearing. Roller 18 comes into rolling-contact with the outer circumferential surface of drive cam 4. The motion transmission section further includes rollers 20, 21 that are rotatably supported on shafts 22, 23 in the grooves of bifurcated end portions 14*d*, 14*d* through ball bearings, respectively. Rollers 20, 21 come into rolling-contact with contact surface 13*a* of rocker cam 5. Rollers 20, 21 transmit the input torque from drive cam 4 to rocker cams 5, 5 in synchronized relation to each other.

The control section includes control shaft 15 disposed in an upward position with respect to drive shaft 3 in parallel relation thereto. As illustrated in FIGS. 1, 2 and 4, control shaft 15 is rotatably supported by bearing 24 common to drive shaft 3. Control shaft 15 is formed with oil introducing passage 15*a* to which lubricating oil is supplied. Oil introducing passage 15*a* extends in the axial direction of control shaft 15 and communicates an oil gallery in the engine. Control shaft 15 also is formed with an oil hole extending in a radial direction of control shaft 15 and communicating oil introducing passage 15*a*. The control section further includes eccentric control cam 16 disposed on an outer circumferential surface of control shaft 15. Eccentric control cam 16 is integrally formed with control shaft 15, on which rocker arm 14 is pivotally supported. Eccentric control cam 16 has a cylindrical cam profile and substantially the same axial length as that of support through-bore 14*b* of rocker arm 14. Eccentric control cam 16 has central axis P1 displaced by a predetermined distance from central axis P of control shaft 15. By rotating control shaft 15 with eccentric control cam 16, a fulcrum of the pivotal motion of rocker arm 14 is displaced so that the pivotal position of rocker arm 14 is varied. Eccentric control cam 16 is formed with an oil hole extending in a radial direction of eccentric control cam 16 and cooperating with the oil hole of control shaft 15 to form oil passage 15*b*. The lubricating oil supplied from oil introducing passage 15*a* is fed to between an outer circumferential surface of eccentric control cam 16 and an inner circumferential surface defining support through-bore 14*b* of rocker arm 14 via oil passage 15*b*.

Bearing 24 includes bearing body 24*a* integrally formed with an upper end portion of cylinder head 1, and two bearing brackets 24*b*, 24*c* overlapped on an upper end of bearing body 24*a*. Bearing brackets 24*b*, 24*c* are fastened to bearing body 24*a* using a pair of bolts 24*d*, 24*d*. Bolts 24*d*, 24*d* extend into bearing brackets 24*b*, 24*c* and bearing body 24*a* in a vertical direction as viewed in FIG. 4. Drive shaft 3 and control shaft 15 are fixedly supported between bearing brackets 24*b*, 24*c*.

Torsion spring 25 is provided for biasing rocker cam 5 such that cam nose 13*c* is rotated toward rollers 20, 21 as indicated by arrows fb of FIG. 4. Torsion spring 25 has one end 25*a* retained at a lower portion of base portion 12 of rocker cam 5 and the other end 25*b* fixed to a side surface of bearing 24 by bolt 26*a*.

Actuation mechanism 7 for actuating the control section of lift varying mechanism 6 includes electric actuator 27 and a ball screw assembly that transmits the rotational driving force of electric actuator 27 to control shaft 15. Electric actuator 27 is mounted to one end portion of an actuator housing, not shown, fixed to a rear end of cylinder head 1. The ball screw assembly is disposed within the actuator housing. In this embodiment, electric actuator 27 is a proportional DC motor having drive shaft 27*a* that is rotatably driven in response to control command signal supplied from controller 28. Controller 28 may be a microcomputer including an input/output interface (I/O), memories (RAM, ROM), and microprocessor or a central processing unit (CPU). Controller 28 receives and processes input information signals from various sensors including crank angle sensor 29, airflow meter 30, engine coolant sensor 31, control-shaft position sensor 32 and the like. Control-shaft position sensor 32 may be a potentiometer that generates a voltage signal corresponding to the angular position of control shaft 15. Controller 28 then judges a current engine operating condition and outputs the control command signal to electric actuator 27 depending on the current engine operating condition.

The ball screw assembly includes ball screw shaft 33 substantially coaxially arranged with drive shaft 27*a* of electric actuator 27, ball nut 34 screwed onto an outer circumferential surface of ball screw shaft 33, link arm 35 connected with one end portion of control shaft 15, and link bracket 36 that mechanically links arm 35 and ball nut 34. Ball screw shaft 33 is formed with a ball recirculation groove on the outer circumferential surface and coupled to drive shaft 27*a* of electric actuator 27. Owing to this coupling, the rotational driving force of electric actuator 27 is transmitted to ball screw shaft 33. Ball nut 34 has a generally cylindrical shape and a spiral guide groove continuously extending on an inner circumferential surface thereof. Ball nut 34 cooperates with ball screw shaft 33 to hold a plurality of balls between the spiral guide groove and the ball recirculation groove and allow a rolling-slide motion of the balls. The thus-constructed ball screw assembly converts the rotational motion of ball screw shaft 33 to a linear motion of ball nut 34 on ball screw shaft 33. The linear motion of ball nut 34 is converted to a pivotal motion of link arm 35 through link bracket 36.

Swing mechanism 8 includes swing arm 37 and pivot 38 on which swing arm 37 is pivotally supported. Specifically, swing arm 37 has one end portion 37*a* contacted with stem end 2*a* of each of intake valves 2, 2, and the other end portion 37*b* pivotally supported by pivot 38. Swing arm 37 is in the form of a frame having an elongated rectangular shape in plan view. Hollow space 39 is defined between one end portion 37*a* and the other end portion 37*b* of swing arm 37. Driven roller 40 is rotatably disposed within hollow space 39 in a position close to one end portion 37*a* of swing arm 37. As illustrated in FIG. 3, hollow space 39 has width W that extends perpendicular to a longitudinal direction of swing arm 37. Width W is larger than thickness W1 of cam lobe 13 of rocker cam 5 which extends perpendicular to a longitudinal direction thereof. With this design of hollow space 39, cam lobe 13 is allowed to enter into hollow space 39 during the pivotal motion of rocker cam 5.

As shown in FIGS. 1 and 4, one end portion 37*a* of swing arm 37 is formed with a retention groove open to a lower side of swing arm 37. One end portion 37*a* is retained by stem end 2*a* of intake valve 2 which is loosely fitted into the retention groove. The other end portion 37*b* of swing arm 37 has engaging recess 37*c* into which pivot 38 is fitted. Engaging recess 37*c* is defined by a generally spherical-curved wall of swing arm 37. Swing arm 37 further includes integrally formed bottom wall 37*d* connected with the curved wall, and opposite side walls cooperating with bottom wall 37*d* and the curved wall to define hollow space 39.

Driven roller 40 is rotatably supported on swing arm 37. Driven roller 40 includes outer ring 40*a*, support shaft 40*b* fixed to the side walls of swing arm 37, and needle roller 40*c* supported on an outer periphery of support shaft 40*b*. An upper periphery of outer ring 40*a* projects upwardly from hollow space 39 of swing arm 37 and comes into rolling-contact with cam surface 13*b* of rocker cam 5.

Figure 7:
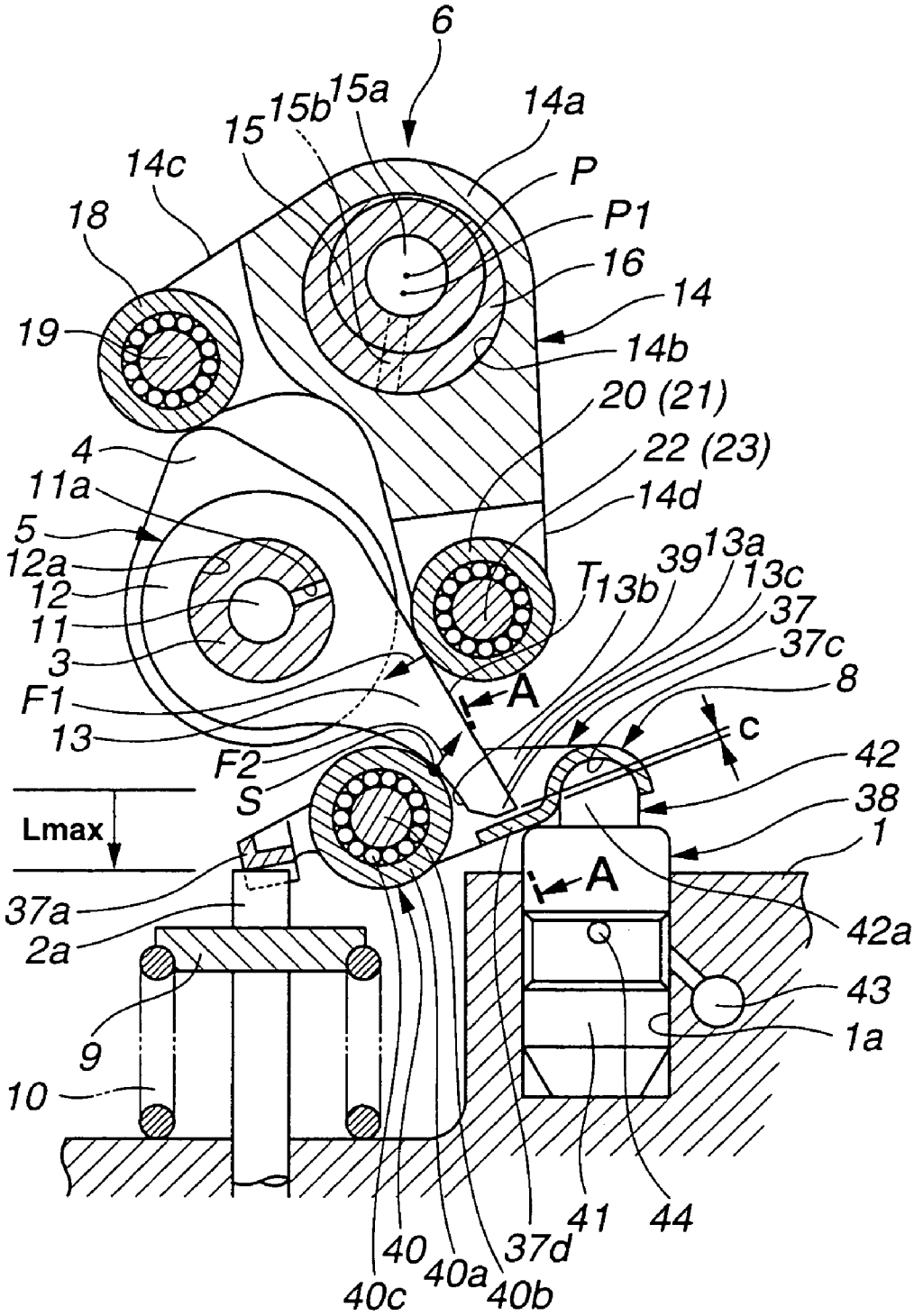
Figure 8:
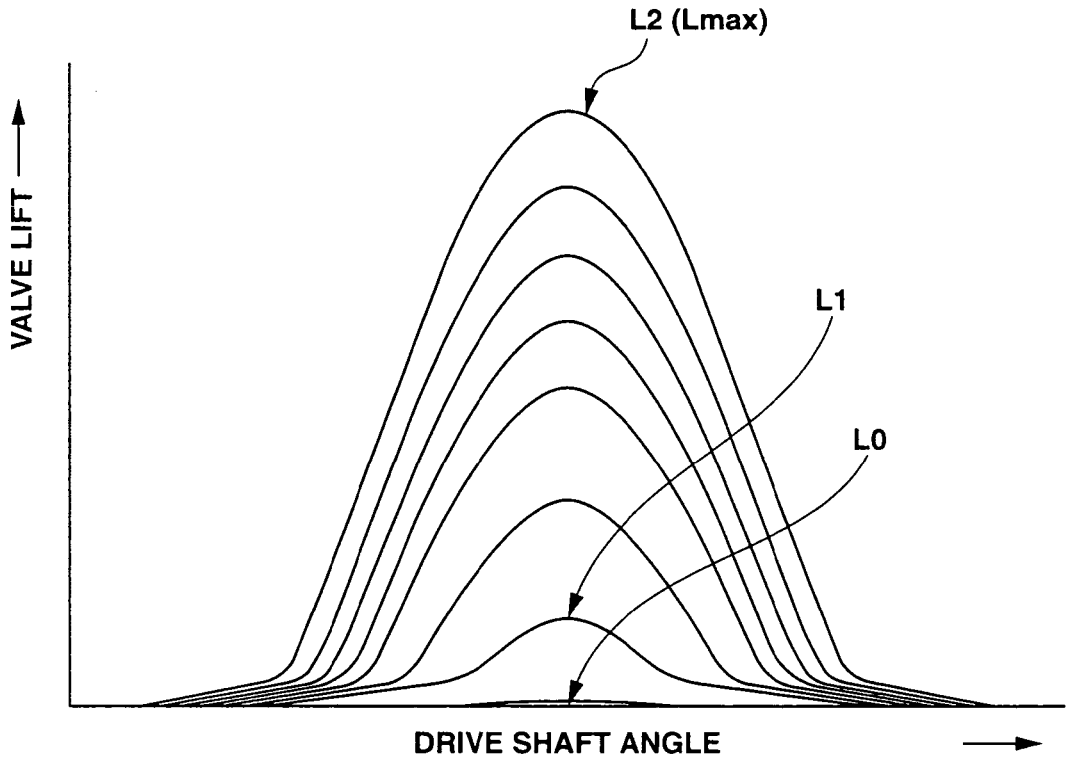
FIG. 8 is a diagram showing a characteristic curve of the lift of the intake valve in the first embodiment of the variable valve operating apparatus.

As illustrated in FIG. 4, rocker cams 5, 5 are interposed between driven rollers 40, 40 on swing arms 37, 37 and rollers 20, 21 on bifurcated end portions 14*d*, 14*d* of rocker arm 14. Each of rocker cams 5, 5 is configured and arranged such that when the lift of intake valve 2 is controlled to a predetermined lift amount or more, each of rollers 20, 21 rolls on and presses against contact surface 13*a* of cam lobe 13 of rocker cam 5 to thereby cause the downwardly pivotal motion of rocker cam 5 and place cam nose 13*c* into hollow space 39 of swing arm 37. Namely, in this state, contact point S between cam surface 13*b* and driven roller 40 is placed within hollow space 39. In this embodiment, when the lift of intake valve 2 is controlled to maximum Lmax as shown in FIG. 7, the downwardly pivotal motion of rocker cam 5 is caused and contact point S between cam surface 13*b* and driven roller 40 is placed within hollow space 39. Further, when cam nose 13*c* is placed in hollow space 39, slight clearance C between the tip end of cam nose 13*c* and an upper side surface of bottom wall 37*d* of swing arm 37 still exists as shown in FIGS. 3 and 4, to thereby prevent interference therebetween.

Pivot 38 is in the form of a so-called hydraulic lash adjuster as shown in FIGS. 1 and 4. Pivot 38 includes a closed-ended cylindrical body 41 fixedly fitted to mount hole 1*a* that is formed in a predetermined position in cylinder head 1, and plunger 42 axially slidably disposed in cylindrical body 41 and having spherical head 42*a* projecting from a distal-end aperture of cylindrical body 41. Head 42*a* is slidably fitted to engaging recess 37*c* of swing arm 37. Pivot 38 further includes a generally cylindrical seat slidably fitted into cylindrical body 41 and having a reservoir chamber and a communication hole. The reservoir chamber is communicated with a higher pressure chamber within body 41 through the communication hole. Pivot 38 further includes a check ball disposed within the higher pressure chamber and biased to close the communication hole by the biasing force of a spring that is supported by a retainer.

The pressurized lubricating oil supplied from oil gallery 43 in cylinder head 1 flows along the outer circumferential surface of body 41 of pivot 38 into the reservoir chamber through oil hole 44 that extends through body 41 and plunger 42. During the closed duration of intake valve 2, plunger 42 is upwardly moved and then the seat also is upwardly moved by the pressurized lubricating oil, urging the check ball to open the communication hole and flowing into the higher pressure chamber. Thus, a valve clearance between stem end 2*a* of intake valve 2 and one end portion 37*a* of swing arm 37 is maintained at zero.

Further, as shown in FIG. 2, two cylindrical spacers 45*a*, 45*b* are fitted onto the outer circumferential surface of drive shaft 3 between drive cam 4 and base portion 12, 12 of rocker cams 5, 5. Spacers 45*a*, 45*b* are provided for axial positioning of drive cam 4 and rocker cams 5, 5 on drive shaft 3. Two cylindrical spacers 46*a*, 46*b* are fitted onto the outer circumferential surface of control shaft 15 on both sides of base portion 14*a* of rocker arm 14. Spacers 46*a*, 46*b* are provided for axial positioning of rocker arm 14 on control shaft 15.

Figure 5:
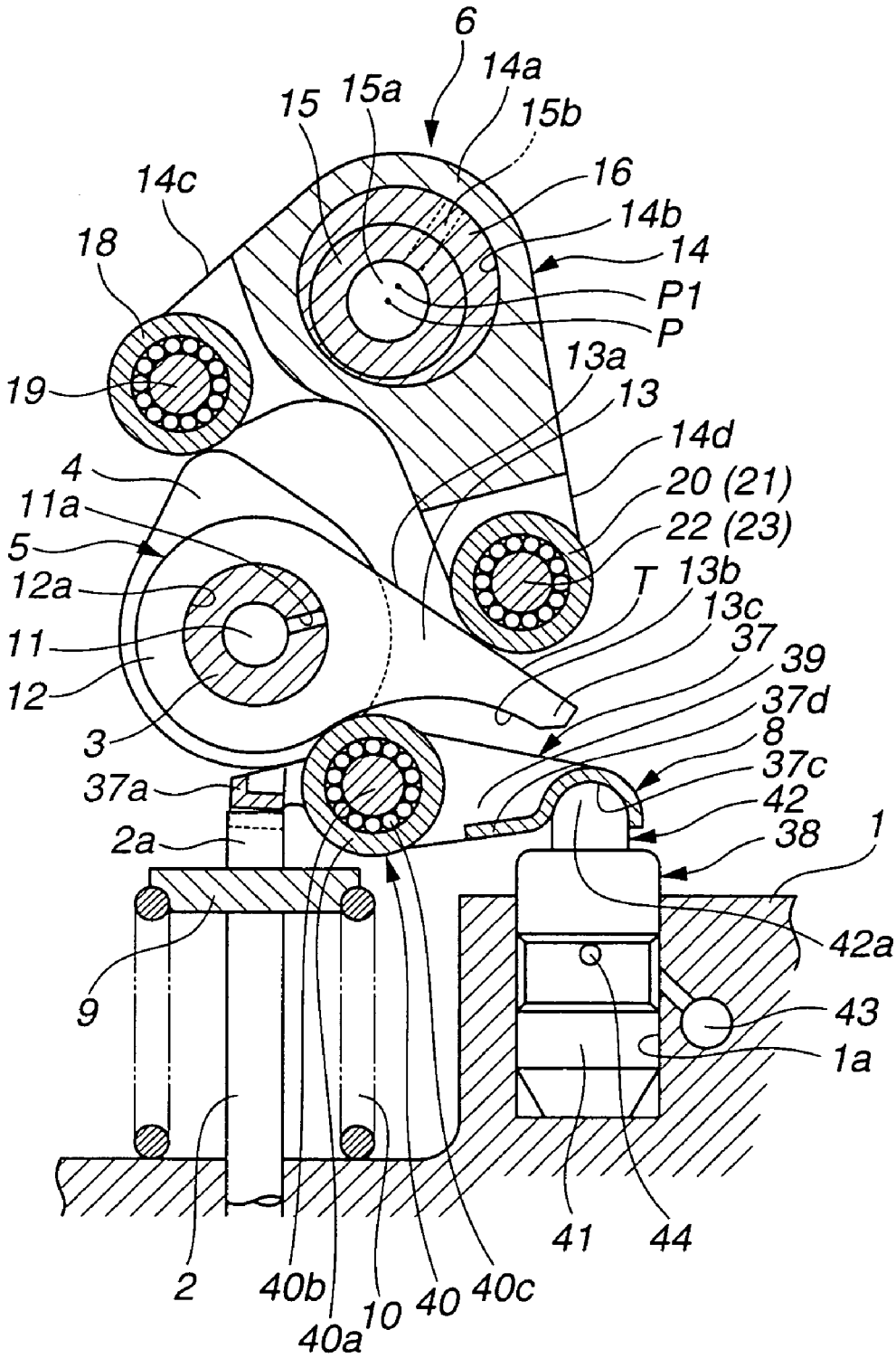

An operation of the variable valve operating apparatus of the first embodiment will be explained hereinafter. When the engine starts up, control current from controller 28 is not supplied to electric actuator 27 of actuator mechanism 7 so that electric actuator 27 generates no torque to drive ball screw shaft 33. In this state, ball nut 34 is held in a maximum linear position and link arm 35 is placed in the corresponding pivotal position through link bracket 36. Control shaft 15 is held in a rotational positions as shown in FIGS. 4 and 5, in which central axis P1 of eccentric control cam 16 is located on the right-upper side with respect to central axis P of control shaft 15. In the rotational positions, control shaft 15 is urged by the spring force of torsion spring 25 via rocker cam 5 and rocker arm 14.

Specifically, in the rotational positions as shown in FIGS. 4 and 5, a thickened portion of eccentric control cam 16 is placed on the right-upward side relative to central axis P of control shaft 15. Namely, central axis P1 of eccentric control cam 16 is right-upwardly offset from central axis P of control shaft 15. Owing to the offset of central axis P1 of eccentric control cam 16 from central axis P of control shaft 15, rocker arm 14 is held in the pivotal position upwardly offset relative to control shaft 15, in which contact points between rollers 20, 21 and contact surfaces 13*a*, 13*a* of cam lobes 13 of rocker cams 5, 5 are kept placed upward of drive shaft 3. On the other hand, rocker cams 5, 5 are urged by spring force fb of torsion spring 25 in a counter-clock direction so as to upwardly move cam noses 13*c*, 13*c*.

In this condition, when drive cam 4 is rotated to lift one end portion 14*c* of rocker arm 14 through roller 18, the lift motion of the one end portion 14*c* is transmitted to rocker cams 5, 5 through rollers 20, 21 at the other bifurcated end portions 14*d*, 14*d* of rocker arm 14. Rocker cams 5, 5 are pivotally moved from the pivotal position as shown in FIG. 4 to the pivotal position as shown in FIG. 5. During the pivotal motion of rocker cams 5, 5, the contact points between rocker cams 5, 5 and driven rollers 40, 40 on swing arms 37, 37 are kept on the base-circle surfaces of cam surfaces 13*b* of rocker cams 5, 5. Therefore, the pivotal motion of swing arms 37, 37 is not caused so that the lift of intake valves 2, 2 becomes zero.

Accordingly, upon the startup of the engine, each of driven rollers 40, 40 on swing arms 37, 37 is reciprocatively rolled on a certain region of the base-circle surface of cam surface 13*b* of rocker cam 5. In this condition, intake valves 2, 2 are held in the closed position in which the valve lift is zero as indicated by characteristic curve L0 in FIG. 8. As a result, friction of the engine is considerably reduced to thereby attain good startability of the engine.

When the engine operation shifts to a low speed range, controller 28 outputs control current to rotate electric actuator 27 by a predetermined amount. Ball screw shaft 33 is rotated by the output torque from electric actuator 27, causing ball nut 34 to linearly move in such a direction as to retreat from the maximum linear position. This causes control shaft 15 with eccentric control cam 16 to be rotated in a clockwise direction as viewed in FIGS. 4 and 5 so that central axis P1 of eccentric control cam 16 is downwardly moved from the positions as shown in FIGS. 4 and 5 by a predetermined small amount, and rocker arm 14 as a whole is displaced by a slight distance toward drive shaft 3. As a result, rollers 20, 21 fitted at bifurcated end portions 14*d*, 14*d* urge cam noses 13*c*, 13*c* of rocker cams 5, 5 to move more downwardly, so that each of rocker cams 5, 5 as a whole is further pivotally rotated in the clockwise direction by a predetermined slight amount.

In this condition, when drive cam 4 is rotated to lift the one end portion 14*c* of rocker arm 14 through roller 18, the lift motion of the one end portion 14*c* is transmitted to rocker cams 5, 5 through rollers 20, 21 to thereby cause rocker cams 5, 5 to be pivotally moved in the clockwise direction. During the pivotal motion of rocker cams 5, 5, the contact points between rocker cams 5, 5 and driven rollers 40, 40 on swing arms 37, 37 are displaced from the base-circle surfaces to the small-lift surfaces via the ramp surfaces of cam surfaces 13*b*, 13*b* of rocker cams 5, 5. Therefore, the lift of intake valves 2, 2 becomes increased.

Accordingly, in the low-speed range of the engine, each of driven rollers 40, 40 on swing arms 37, 37 is reciprocatively rolled over the region of cam surface 13*b* of rocker cam 5 which extends between the base-circle surface and the small-lift surface via the ramp surface. In this condition, the lift of intake valves 2, 2 becomes relatively small as indicated by characteristic curve L1 in FIG. 8, thus resulting in small retardation in an opening timing of intake valves 2, 2 and small reduction of a valve overlap in which the open durations of intake valves 2, 2 and exhaust valves are overlapped. In addition, intake gas motion is enhanced. This serves for improving fuel economy and attaining stable engine operation.

Figure 6:
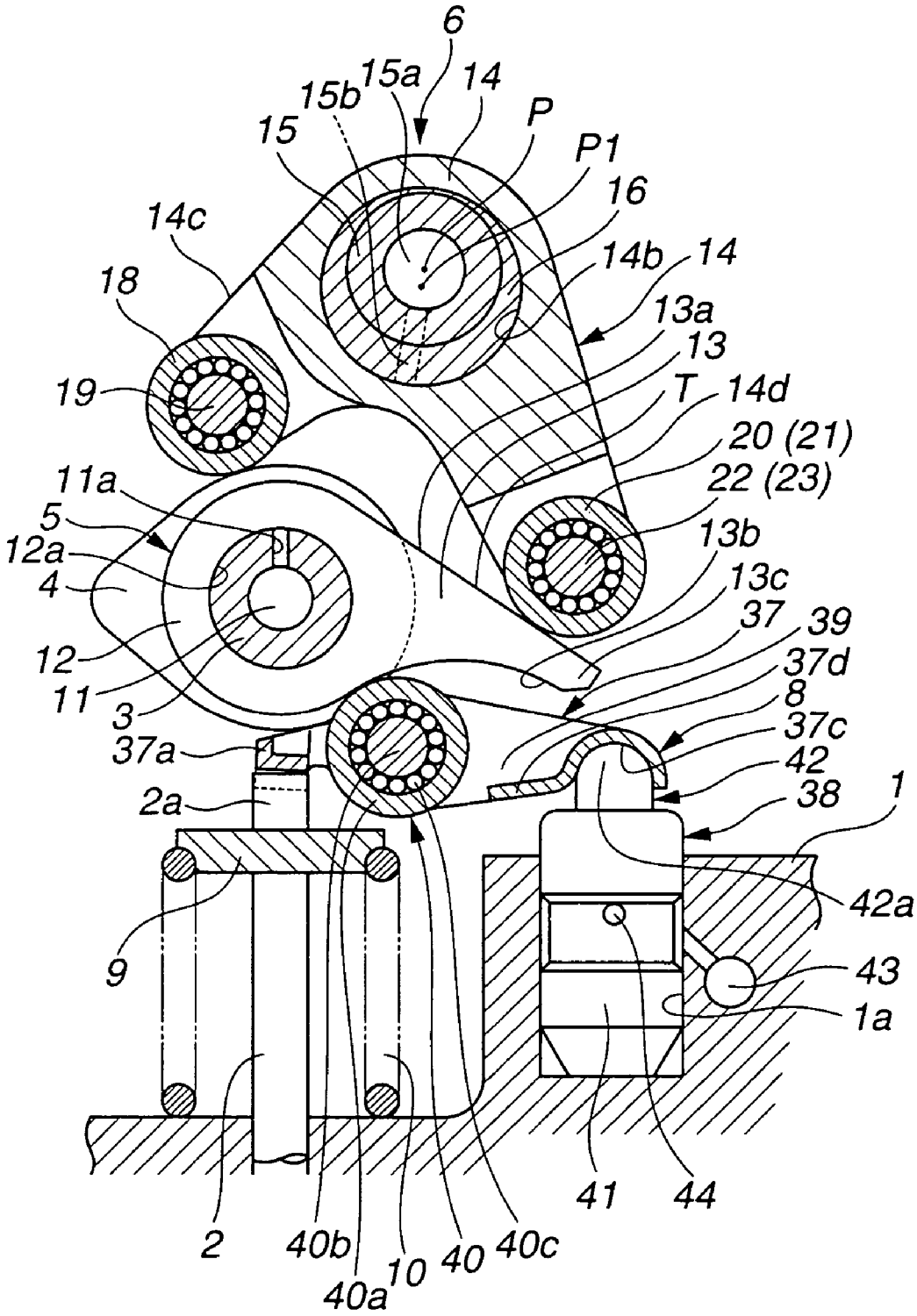
FIGS. 6 and 7 are vertical cross-sections of the first embodiment of the variable valve operating apparatus, showing an operation of maximum lift control of the intake valve.

When the engine operation shifts from the low-speed range to a high-speed range, electric actuator 27 is further rotated in response to control command signal from controller 28, thereby causing ball nut 34 to further linearly move in the same direction. Control shaft 15 with eccentric control cam 16 is caused to be further rotated in the clockwise direction so that central axis P1 of eccentric control cam 16 is further downwardly moved to the positions as shown in FIGS. 6 and 7. This causes rocker arm 14 to be downwardly displaced closer to drive shaft 3, so that rollers 20, 21 at bifurcated end portions 14*d*, 14*d* urge cam noses 13*c*, 13*c* of rocker cams 5, 5 to move further downwardly. Each of rocker cams 5, 5 as a whole is pivotally rotated in the clockwise direction by a predetermined largest amount.

In this condition, when drive cam 4 is rotated to lift the one end portion 14*c* of rocker arm 14 through roller 18, the lift motion of the one end portion 14*c* is transmitted to rocker cams 5, 5 through rollers 20, 21 to thereby cause rocker cams 5, 5 to be pivotally further moved in the clockwise direction and placed in the maximum pivotal position as shown in FIG. 7. During the pivotal motion of rocker cams 5, 5, the contact points between rocker cams 5, 5 and driven rollers 40, 40 on swing arms 37, 37 are displaced from the base-circle surfaces to the maximum-lift surfaces via the ramp surfaces and the small-lift surfaces of cam surfaces 13*b*, 13*b* of rocker cams 5, 5. Therefore, the lift of intake valves 2, 2 is varied to the maximum height.

Accordingly, in the high-speed range of the engine, each of driven rollers 40, 40 on swing arms 37, 37 is reciprocatively rolled over the region of cam surface 13*b* of rocker cam 5 which extends between the base-circle surface and the maximum-lift surface via the ramp surface and the small-lift surface. In this condition, the lift of intake valves 2, 2 becomes maximum as indicated by characteristic curve L2 in FIG. 8. This results in advancement in an opening timing of intake valves 2, 2 and retardation in a closing of timing of intake valves 2, 2, thereby serving for enhancing charging efficiency of intake air and ensuring sufficient engine power output.

Upon the maximum valve lift control as explained above, as illustrated in FIG. 7, rocker cams 5, 5 are pivotally moved so that cam surfaces 13*b*, 13*b* push down the one end portions 37*a*, 37*a* of swing arms 37, 37 to thereby open intake valves 2, 2. In this state, each of contact points S between cam surfaces 13*b*, 13*b* of rocker cams 5, 5 and driven rollers 40, 40 is placed in hollow space 39 of swing arm 37. As a result, the occurrence of interference between swing arms 37, 37 and cam noses 13*c*, 13*c* of rocker cams 5, 5 can be prevented, and the pivotal angle of rocker cams 5, 5 can be increased. This serves for ensuring the large valve lift in absolute value.

Further, upon the maximum valve lift control as illustrated in FIG. 7, contact portions T, T of contact surface 13*a*, 13*a* of rocker cams 5, 5 which are in contact with respective rollers 20, 21 on rocker arms 14, 14, are placed in hollow spaces 39, 39 of swing arms 37, 37. This achieves a further increased pivotal angle of rocker cams 5, 5.

Thus, the increased pivotal angle of rocker cams 5, 5 can be ensured by introducing the side of cam noses 13*c*, 13*c* into hollow spaces 39, 39 of swing arms 37, 37 without increasing the size of rocker cams 5, 5. Therefore, the variable valve operating apparatus of this embodiment can be prevented from suffering from structural enlargement, and can achieve downsizing.

Further, upon the lift and opening operation of intake valves 2, 2, the input torque from drive cam 4 is transmitted to rocker cams 5, 5 via rollers 20, 21 on rocker arm 14. At this time, as illustrated in FIG. 7, driving force F1 transmitted to rocker cams 5, 5 via rollers 20, 21 and reaction force F2 of valve springs 10, 10 of intake valves 2, 2 act on rocker cams 5, 5 in substantially diametrically opposed directions. This results in cancellation of driving force F1 and reaction force F2 to thereby prevent an excessive load from exerting on base portions 12, 12 of rocker cams 5, 5. This serves for reducing the thickness of base portion 12 of rocker cams 5, 5 which extends in the axial direction of central bore 12*a* of base portion 12, and reducing the load applied to base portion 12. Accordingly, the variable valve operating apparatus of this embodiment can be entirely downsized.

Further, since rocker arm 14 has the symmetrical-branched shape with respect to the center line perpendicular to the axial direction of control shaft 15, reaction force F2 of valve springs 10, 10 as shown in FIG. 7 substantially equally is applied to bifurcated end portions 14*d*, 14*d* through rollers 20, 21. Rocker arm 14, therefore, can be prevented from being tilted in the direction as indicated by arrow D in FIG. 1. This results in suppressing occurrence of imbalance in the distribution of the pressing force of rocker arm 14 to rocker cams 5, 5, thereby preventing occurrence of dispersion in the lift amount between intake valves 2, 2.

Further, upon the maximum valve lift control as illustrated in FIG. 7, the tip end of cam nose 13*c* of each of rocker cams 5, 5 is opposed to the upper side surface of bottom wall 37*d* of each of swing arms 37, 37 with slight clearance C therebetween. This serves for providing a further increased lift amount of intake valves 2, 2. In addition, with the provision of bottom wall 37*d* of swing arm 37, the rigidity of swing arm 37 can be enhanced.

Furthermore, as described above, drive cam 4 and rocker cams 5, 5 are arranged on the common shaft, i.e., drive shaft 3. This serves for further downsizing the variable valve operating apparatus of this embodiment.

Further, with the provision of rollers 18, 20 and 21 at one end portion 14*c* and bifurcated end portions 14*d*, 14*d* of rocker arm 14, respectively, the frictional resistance caused between drive cam 4 and one end portion 14*c* of rocker arm 14 and between bifurcated end portions 14*d*, 14*d* of rocker arm 14 and each of rocker cams 5, 5 can be considerably reduced.

Especially, with the provision of rollers 20, 21 on bifurcated end portions 14*d*, 14*d* of rocker arm 14, the pivotal motion of rocker cams 5, 5 can be stabilized when the lift of intake valves 2, 2 becomes near a peak lift upon the maximum valve lift control. Specifically, between before and after the peak lift of intake valves 2, 2, a direction of displacement of the contact points between rollers 20, 21 and contact surfaces 13*a*, 13*a* of rocker cams 5, 5 is reversed to thereby cause reverse of a direction of the frictional force generated therebetween. Therefore, there occurs a tendency that the pivotal motion of rocker cams 5, 5 becomes unstable. In this embodiment using rollers 20, 21, the frictional resistance per se can be reduced, thereby suppressing a change in the frictional force which is caused due to the reverse of the direction of displacement of the contact points between before and after the peak lift of intake valves 2, 2. As a result, the pivotal motion of rocker cams 5, 5 can be stabilized.

Since the frictional resistance caused between rocker arm 14 and contact surfaces 13*a*, 13*a* of rocker cams 5, 5 through rollers 20, 21 can be considerably reduced, the change in the frictional force can be reduced in absolute value. This serves for preventing rocker arm 14 from suffering from torsional stress that is caused upon occurrence of the change in the frictional force, thereby preventing occurrence of difference in lift amount between two intake valves 2, 2.

In addition, in the first embodiment, the lubricating oil flowing from oil passage 15*b* via oil introducing passage 15*a* in control shaft 15 sufficiently lubricates the outer circumferential surface of eccentric control cam 16 and the inner circumferential surface of support through-bore 14*b* of rocker arm 14. The lubricating oil then flows on the outer surface of rocker arm 14 and is supplied to respective rollers 18, 20 and 21 via respective end portions 14*c*, 14*d*, 14*d* of rocker arm 14.

On the other hand, the lubricating oil flowing from oil hole 11*a* via oil passage 11 in drive shaft 3 lubricates the outer circumferential surface of drive shaft 3 and the circumferential periphery of central bore 12*a* of base portion 12 of each of rocker cams 5, 5. The lubricating oil then flows on the outer surface of base portion 12 of each of rocker cams 5, 5 and is supplied to each of driven rollers 40, 40. The lubricating oil lubricates the outer surface of each of driven rollers 40, 40 and cam surface 13*b* of each of rocker cams 5, 5.

Accordingly, the lubrication of respective rollers 18, 20, 21 and 40 can be enhanced, and the frictional resistance caused between rollers 18, 20, 21 and 40 and contact surfaces 13*a*, 13*a* and cam surfaces 13*b*, 13*b* of rocker cams 5, 5 can be further reduced.

Further, in this embodiment, two rollers 20 and 21 as the motion transmission section can be operated by single drive cam 4. As compared to a variable valve operation apparatus using two drive cams, the production cost of the variable valve operation apparatus of this embodiment can be saved and the downsizing can be promoted.

Further, with the arrangement of drive cam 4 in the upward position upwardly spaced from the axis of the engine valve, i.e., intake valves 2, 2, the variable valve operation apparatus of this embodiment can be further downsized.

Further, a camshaft bore of a cylinder head which is used for designing a conventional direct-driven valve operating apparatus can be used as that of drive shaft 3, i.e., a camshaft, of the variable valve operation apparatus of this embodiment. This serves for facilitating installation of the variable valve operation apparatus of this embodiment to the conventional cylinder head. In addition, a layout of pulleys and a chain or timing belt which are used for driving the camshaft in the conventional internal combustion engine equipped with the direct-driven valve operating apparatus can be applied to the engine having the variable valve operation apparatus of this embodiment.

Further, when the lift of intake valves 2, 2 is the predetermined amount or more, i.e., the maximum valve lift, not only cam surface 13*b* of each of rocker cams 5, 5 but also contact surface 13*a* thereof opposed to cam surface 13*b* are located within hollow space 39 of each of swing arms 37, 37. This results in preventing interference between rocker cam 5 and swing arm 37 and further enhancing the valve lift.

Furthermore, as described above, when the lift of intake valves 2, 2 is the predetermined amount or more, i.e., the maximum valve lift and the pivotal position of rocker cams 5, 5 is the maximum pivotal position, the tip end of cam nose 13*c* of each of rocker cams 5, 5 is opposed to bottom wall 37*d* of each of swing arms 37, 37 with slight clearance C therebetween. This serves for further increasing the valve lift. In addition, with the provision of bottom wall 37*d*, the rigidity of swing arm 37 can be enhanced.

The variable valve operating apparatus of the present invention is not limited to the first embodiment and may be applied to exhaust valves or both intake valves and exhaust valves.

Referring to FIGS. 9-16, there is shown a second embodiment of the variable valve operating apparatus, which differs from the first embodiment in the construction and arrangement of the drive shaft, the rocker cam and the lift varying mechanism. Like reference numerals denote like parts, and therefore, detailed explanations therefor are omitted.

Figure 11:
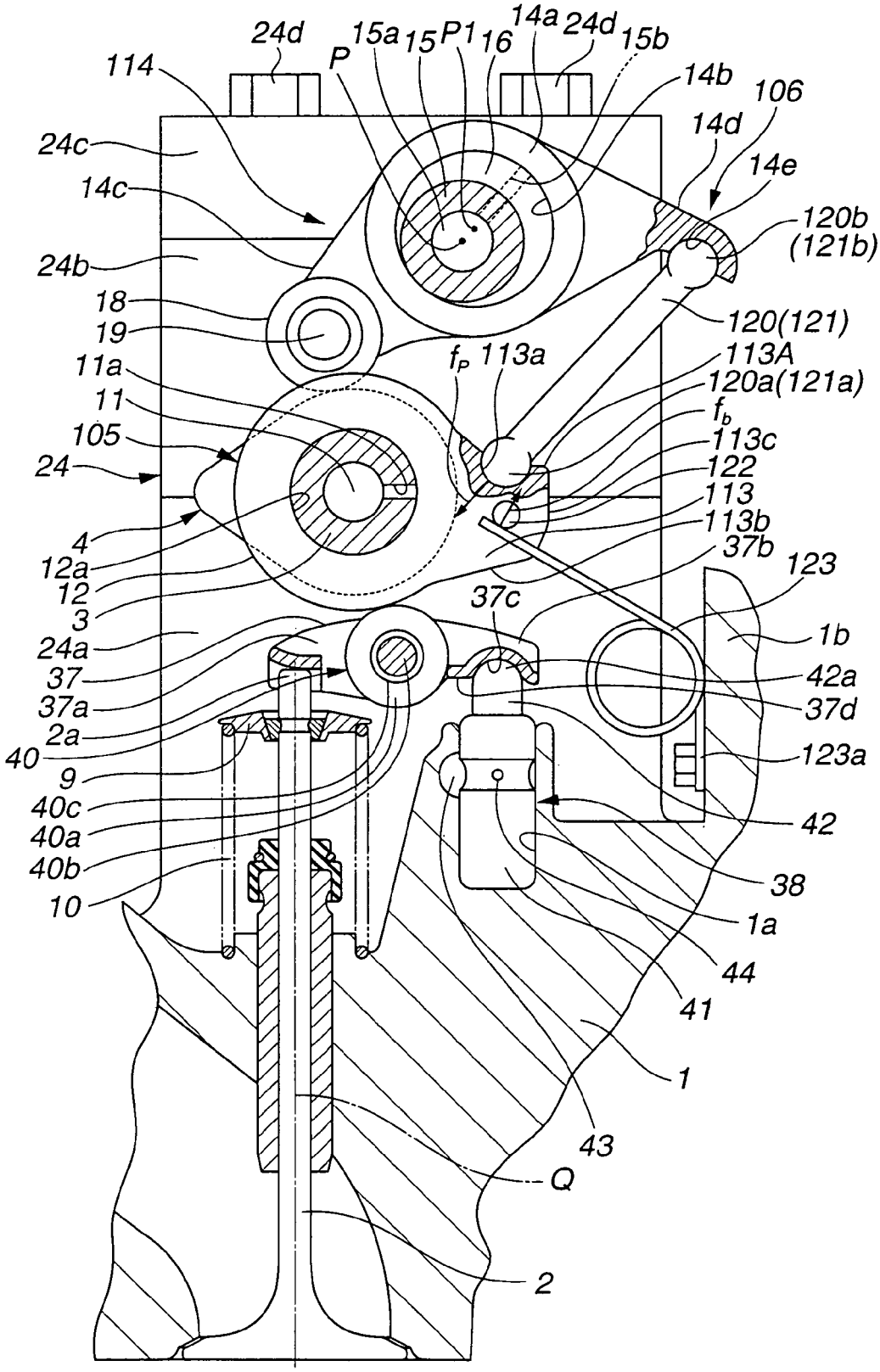
FIGS. 11 and 12 are vertical cross-sections of the second embodiment of the variable valve operating apparatus, showing an operation of low-lift control of an intake valve.

Drive shaft 3 is disposed in the upward position relative to axis Q of intake valves 2, 2 as explained in the first embodiment, but in this embodiment as illustrated in FIG. 11, the rotation axis of drive shaft 3 is placed closer to a central portion of cylinder head 1 as compared with axis Q of intake valves 2, 2.

Two rocker cams 105, 105 are pivotally disposed on drive shaft 3 on both axial sides of drive cam 4. Each of rocker cams 105, 105 differs from rocker cam 5 of the first embodiment in configuration of cam lobe 113. As illustrated in FIG. 11, rocker cam 105 has generally rectangular-shaped cam lobe 113 substantially radially projecting from base portion 12. Rocker cam 105 includes planar contact surface 113A extending on an upper side of cam lobe 113 and formed with generally semispherical-shaped recessed portion 113*a*, and cam surface 113*b* extending from the side of base portion 12 to the side of cam nose 113*c* along a lower side of cam lobe 113. Contact surface 113A and cam surface 113*b* are located in an opposed relation to each other with respect to a direction of the pivotal motion of rocker cam 105. Cam surface 113*b* is formed into a substantially arcuate-curved surface and includes a part of a base-circle surface of base portion 12, a ramp surface continuously extending from the part of a base-circle surface of base portion 12 toward the tip end portion of cam nose 113*c*, a maximum-lift surface near cam nose 113*c* and a small-lift surface extending between the ramp surface and the maximum-lift surface.

Figure 9:
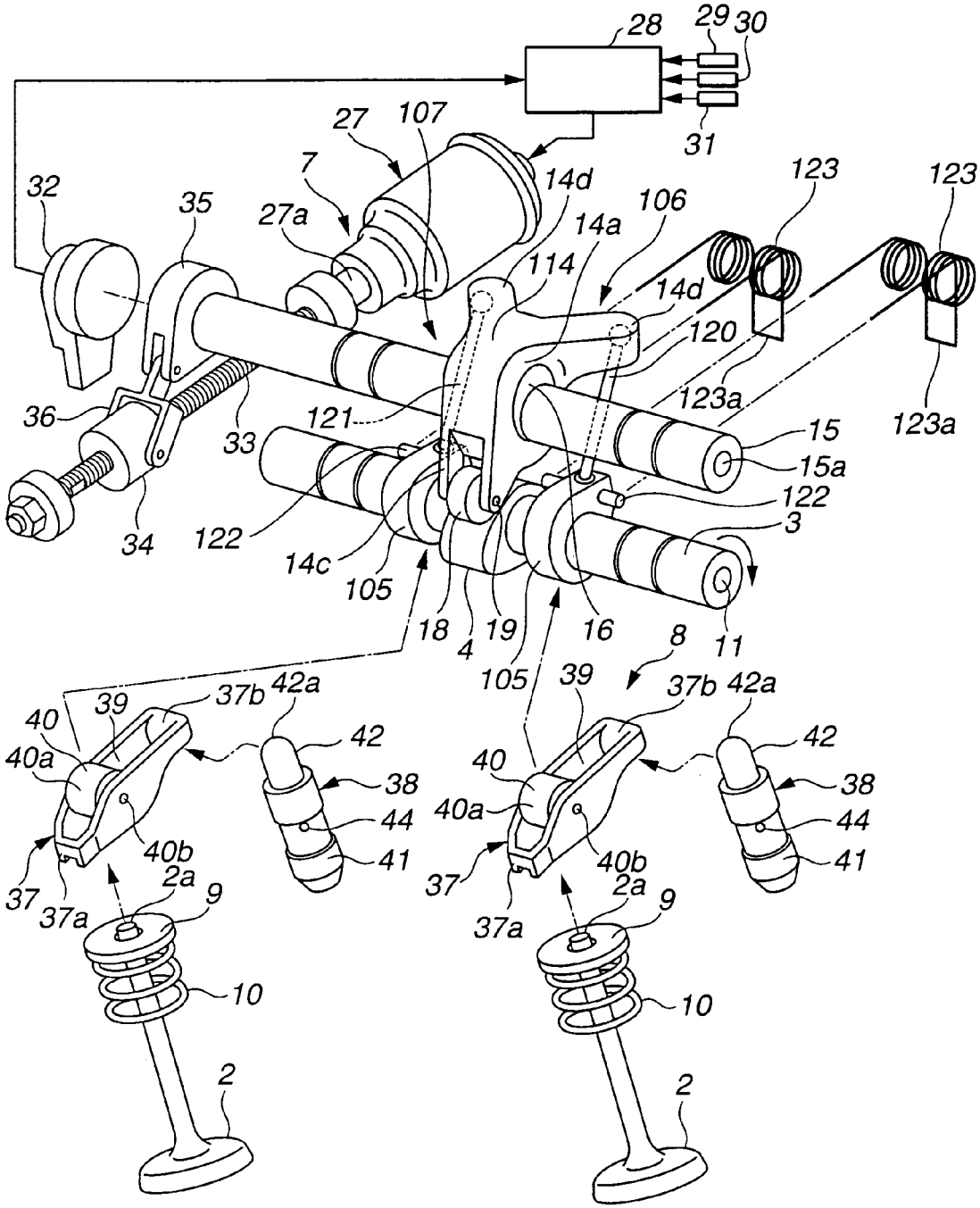
FIG. 9 is a view similar to FIG. 1, but showing a second embodiment of the variable valve operating apparatus according to the present invention.

Lift varying mechanism 106 includes rocker section including rocker arm 114 mechanically linking drive cam 4 to rocker cam 105 to convert the rotational motion of drive cam 4 to the pivotal motion of rocker arm 114, a motion transmission section for transmitting the pivotal motion of rocker arm 114 to rocker cam 105, and control section 107 for altering the pivotal position of rocker arm 114. Rocker arm 114 has a substantially symmetrical-branched shape with respect to a center line thereof extending perpendicular to a pivot axis thereof in plan view. In the second embodiment, rocker arm 114 has a generally Y-shape in plan view and a generally L-shape when viewed from the fore-and-aft direction of the engine. Rocker arm 114 differs from rocker arm 14 of the first embodiment in that generally semispherical-shaped recessed portions 14*e*, 14*e* are formed in bifurcated end portions 14*d*, 14*d* extending from base portion 14*a* toward contact surface 113A of cam lobe 113 of rocker cam 105. One end portion 14*c* has a slit-shaped groove at a distal end portion thereof as shown in FIG. 9.

The motion transmission section includes push rods 120, 121 which transmit the input torque from drive cam 4 to rocker cams 105, 105 and operate rocker cams 105, 105 in synchronized relation to each other. Each of push rods 120, 121 straightly extends and has a circular shape in cross-section. Push rod 120 has generally spherical-shaped pivot end portions 120*a*, 120*b* at opposite ends thereof. Pivot end portions 120*a*, 120*b* are integrally formed with push rod 120. Similarly, push rod 121 has generally spherical-shaped pivot end portions 121*a*, 121*b* at opposite ends thereof. Pivot end portions 121*a*, 121*b* are integrally formed with push rod 121. Pivot end portions 120*a*, 120*b* of push rod 120 are slidably engaged in recessed portion 113*a* of rocker cam 105 and recessed portion 14*e* of one of two bifurcated end portions 14*d*, 14*d* of rocker arm 114, respectively. Pivot end portions 121*a*, 121*b* of push rod 121 are slidably engaged in recessed portion 113*a* of rocker cam 105 and recessed portion 14*e* of the other of two bifurcated end portions 14*d*, 14*d* of rocker arm 114, respectively. In this embodiment, push rods 120, 121 have same lengths but may be configured to have different lengths from each other.

Rocker cams 105, 105 are biased in a substantially axial direction of push rods 120 and 121 by torsion springs 123, 123 via retainer pins 122, 122. Each of torsion springs 123, 123 includes middle portion 123*a* and two end portions inclined relative to middle portion 123*a* and project toward rocker cam 105. Middle portion 123*a* is fixed to wall 1*b* of cylinder head 1 by means of a bolt. The two end portions are installed to cam lobes 113, 113 of rocker cams 105, 105, respectively. The two end portions of torsion spring 123 is resiliently contacted with retainer pin 122 projecting from cam lobe 113 of each of rocker cams 105, 105. Specifically, retainer pin 122 is press-fitted into and fixed to a portion of cam lobe 113 which is located near cam nose 113*c*, in the thickness direction of cam lobe 113, namely, in the axial direction of rocker cam 105. Retainer pin 122 includes opposite end portions projecting from opposite surfaces of cam lobe 113 which are opposed to each other in the axial direction of rocker cam 105, by a predetermined length. As shown in FIG. 11, a lower periphery of each of the opposite end portions of retainer pin 122 is contacted with and biased by each of the two end portions of torsion spring 123.

Control section 107 includes control shaft 15 and eccentric control cam 16 integrally formed with control shaft 15, as described in the first embodiment. Control section 107 thus has the same construction as that of the first embodiment and is operated by actuation mechanism 7 as explained in the first embodiment.

As illustrated in FIG. 11, rocker cams 105, 105 are interposed between driven rollers 40, 40 on swing arms 37, 37 and push rods 120, 121 on bifurcated end portions 14*d*, 14*d* of rocker arm 114. Rocker cams 105, 105 are arranged such that when operated, spring force fb of each of torsion springs 123, 123 and pressing force fp applied to each of rocker cams 105, 105 via push rods 120, 121 act in substantially opposite directions to thereby cancel the load caused by spring force fb and pressing force fp.

Figure 10:
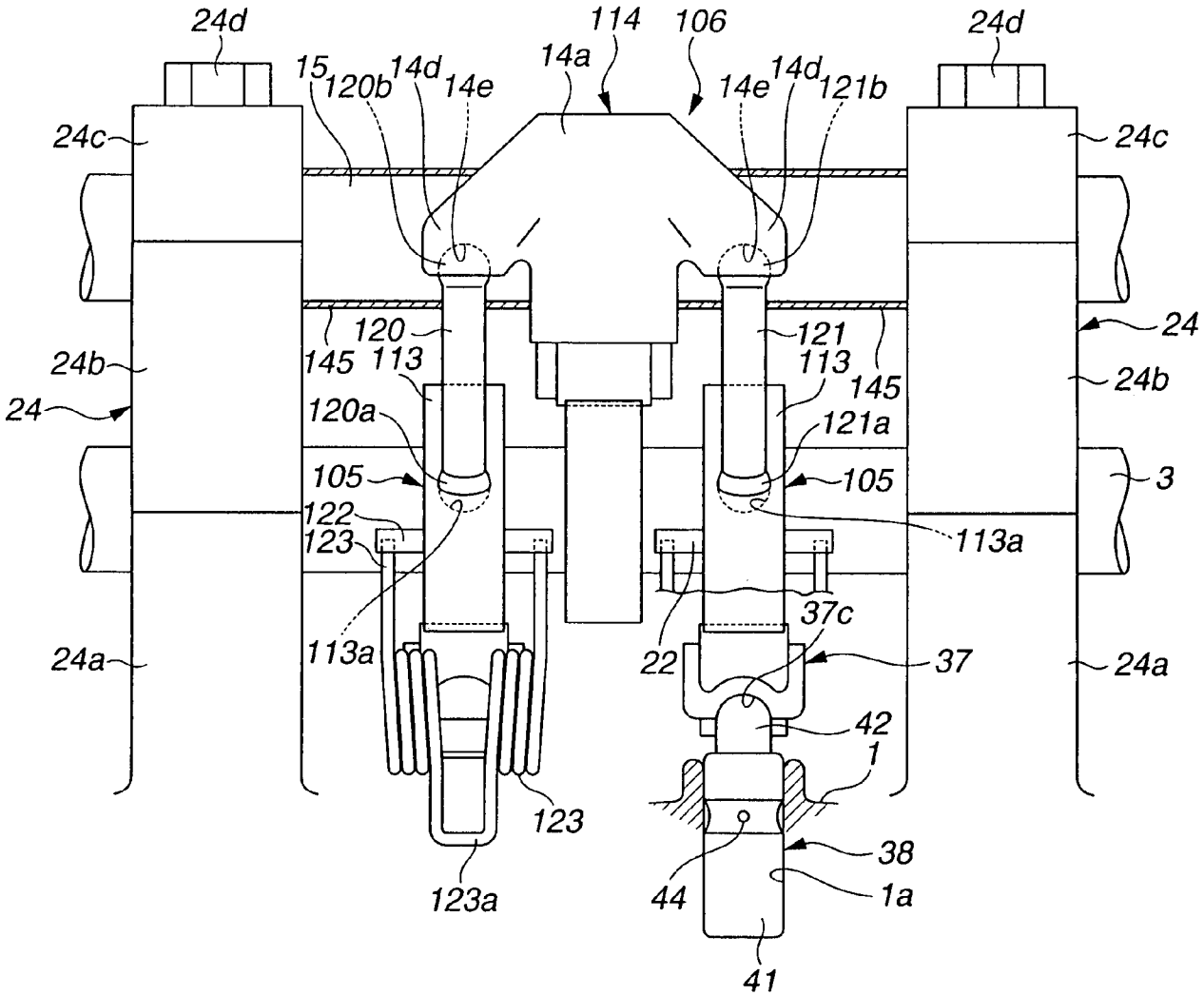
FIG. 10 a side view of an essential part of the variable valve operating apparatus as shown in FIG. 9.

Further, as shown in FIG. 10, two cylindrical spacers 145, 145 are fitted onto the outer circumferential surface of control shaft 15 on both sides of base portion 14*a* of rocker arm 114. Spacers 46*a*, 46*b* are provided for axial positioning of rocker arm 14 on control shaft 15.

Figure 12:
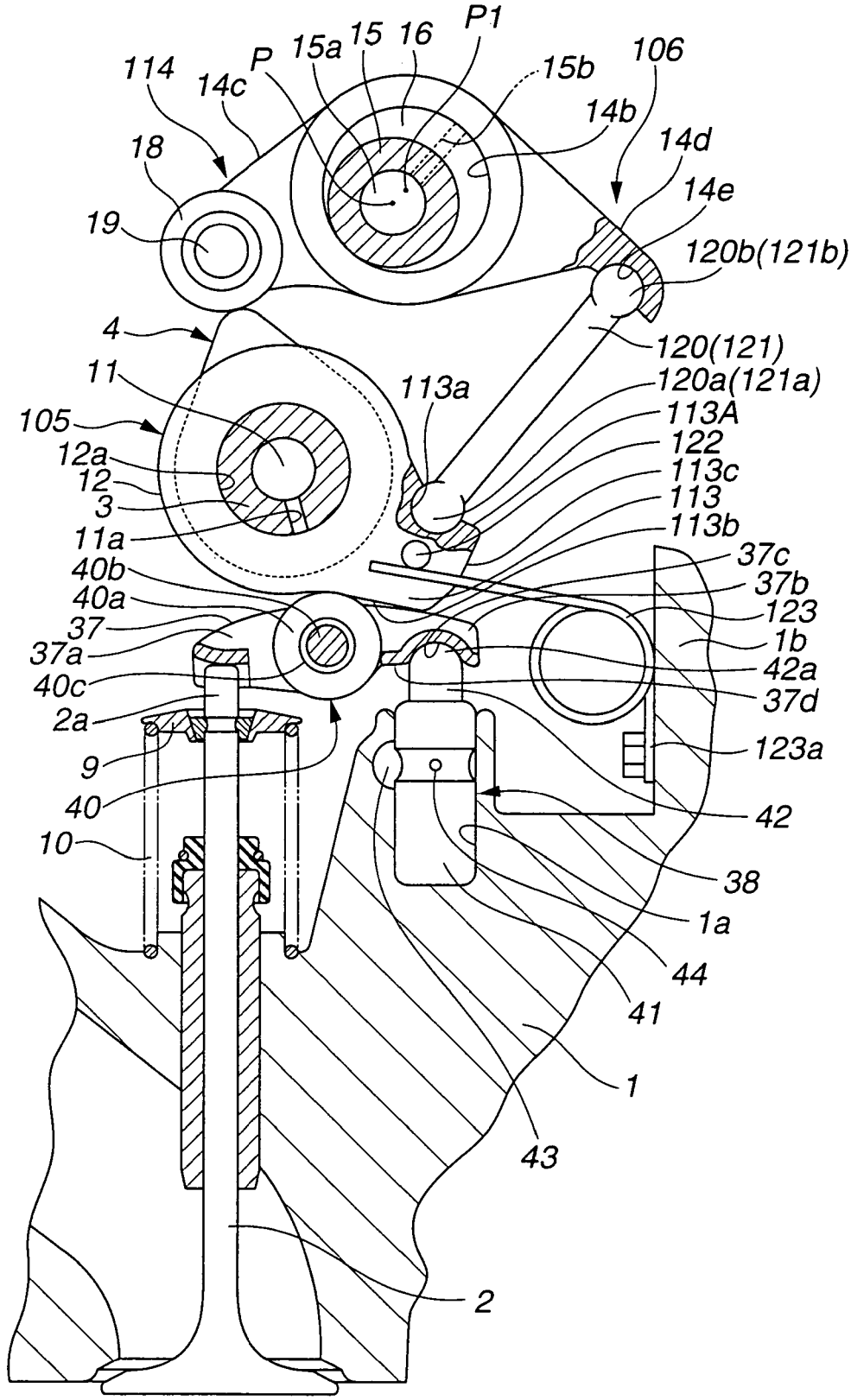

An operation of the variable valve operating apparatus of the second embodiment will be explained hereinafter. When the engine is operated in a low speed range, controller 28 outputs control current to rotate electric actuator 27 in a predetermined direction. Ball screw shaft 33 is rotated by the output torque from electric actuator 27, causing ball nut 34 to linearly move to a predetermined linear position on ball screw shaft 33. In this state, control shaft 15 is held in rotational positions as shown in FIGS. 11 and 12 by link bracket 36 and link arm 35. In the rotational positions, central axis P1 of eccentric control cam 16 is located on the right-upper side with respect to central axis P of control shaft 15. Thus, rocker arm 114 is placed in an upward pivotal position with respect to control shaft 15. On the other hand, rocker cams 105, 105 are biased by the spring forces of torsion springs 123, 123 such that cam noses 113*c*, 113*c* are urged onto pivotal portions 120*a*, 121*a* of push rods 120, 121, namely, in a counter-clockwise direction.

In this condition, as illustrated in FIG. 11, when drive cam 4 is in the rotational position in which the base-circle portion is in contact with roller 18, the one end portion 14*c* of rocker arm 114 is not pushed up so that intake valves 2, 2 are in the closed position. When drive cam 4 is then rotated to be placed in the rotational position as shown in FIG. 12, the cam nose of drive cam 4 is in contact with roller 18 and pushes up the one end portion 14*c* of rocker arm 114 through roller 18. The lift motion of the one end portion 14*c* is transmitted to rocker cams 105, 105 through push rods 120, 121 on bifurcated end portions 14*d*, 14*d* to thereby cause rocker cams 105, 105 to be pivotally moved in the clockwise direction. During the pivotal motion of rocker cams 105, 105, the contact points between rocker cams 105, 105 and driven rollers 40, 40 on swing arms 37, 37 are displaced from the base-circle surfaces to the small-lift surfaces via the ramp surfaces of cam surfaces 113*b*, 113*b* of rocker cams 105, 105. Therefore, the lift of intake valves 2, 2 becomes increased.

Accordingly, in the low-speed range of the engine, each of driven rollers 40, 40 on swing arms 37, 37 is reciprocatively rolled over the region of cam surface 113*b* of rocker cam 105 which extends between the base-circle surface and the small-lift surface via the ramp surface. In this condition, the lift of intake valves 2, 2 becomes relatively small as indicated by characteristic curve L1 in FIG. 15. This results in retardation in an opening timing of intake valves 2, 2 and reduction of a valve overlap in which the open durations of intake valves 2, 2 and exhaust valves are overlapped. In addition, intake gas motion is enhanced. This serves for improving fuel economy and attaining stable engine operation.

Figure 13:
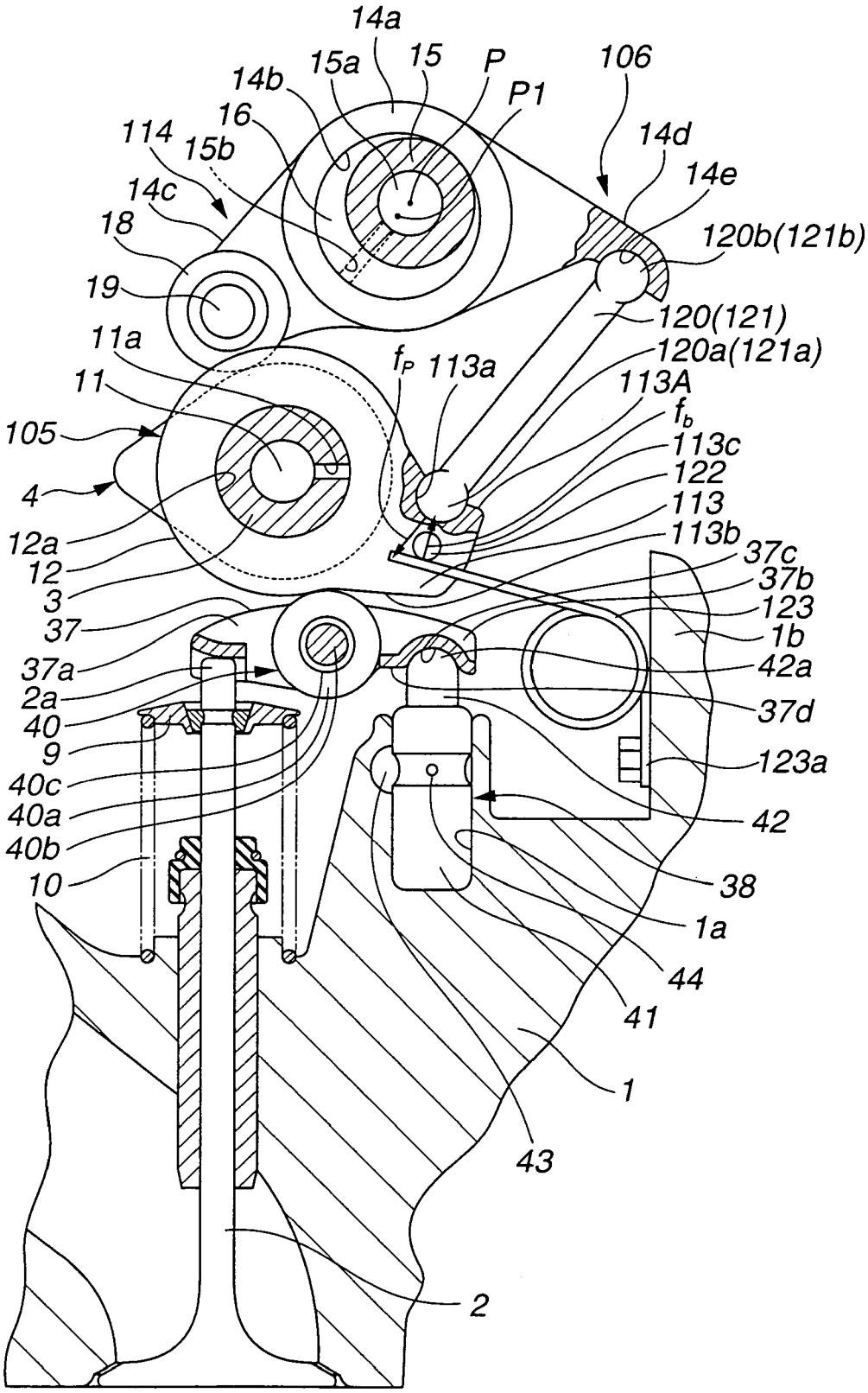
FIGS. 13 and 14 are vertical cross-sections of the second embodiment of the variable valve operating apparatus, showing an operation of maximum lift control of the intake valve.
Figure 14:
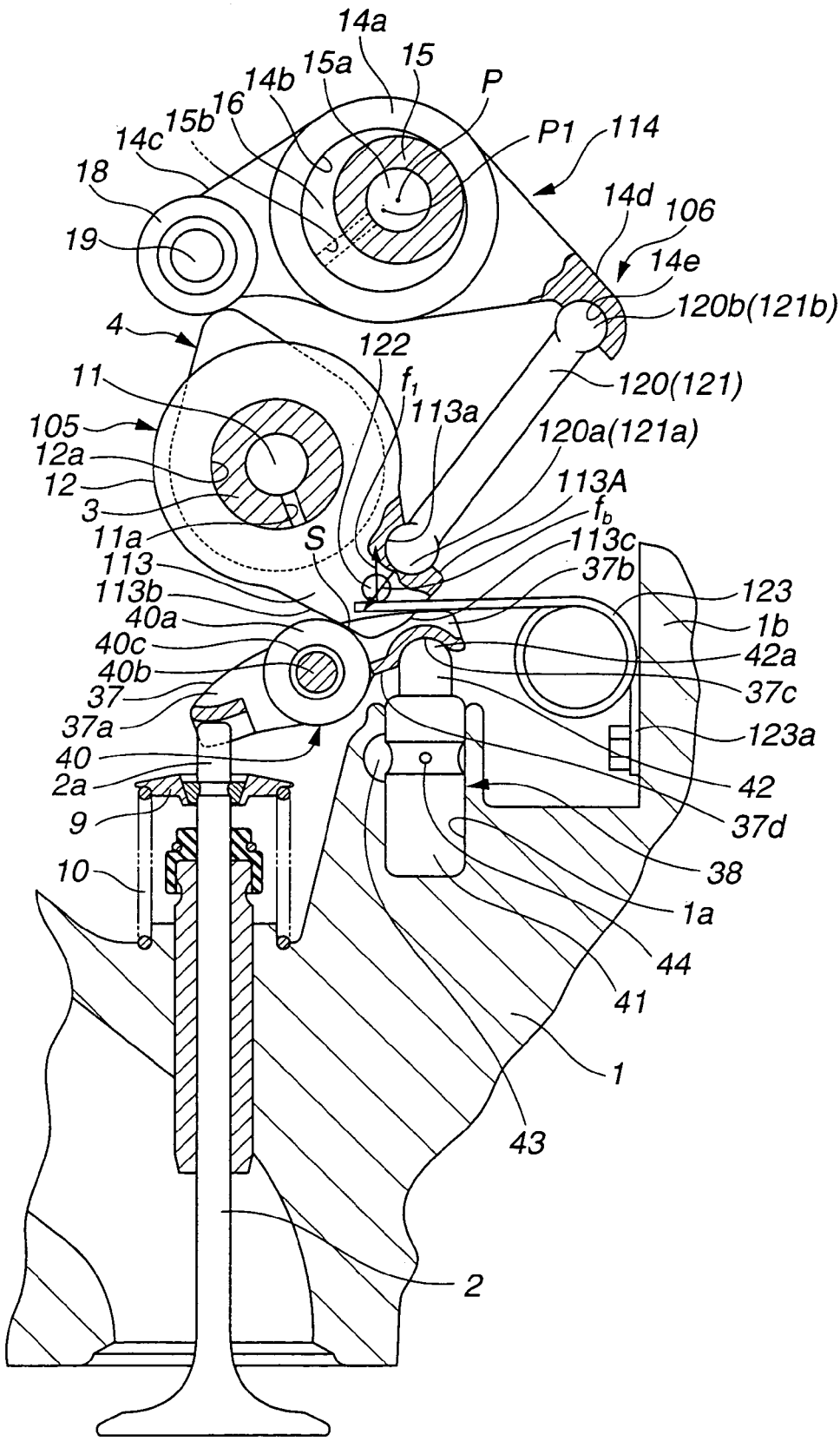
Figure 15:
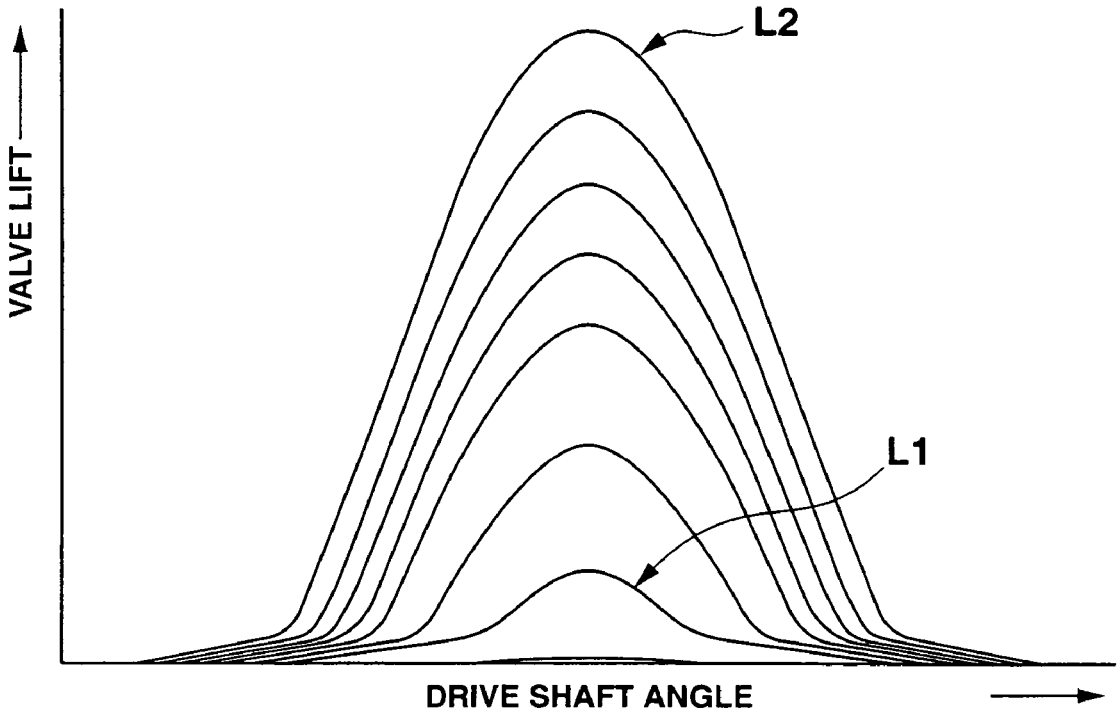
FIG. 15 is a diagram showing a characteristic curve of the lift of the intake valve in the second embodiment of the variable valve operating apparatus.

When the engine operation shifts from the low-speed range to a high-speed range, controller 28 outputs reverse control current to rotate electric actuator 27 in the reverse direction, thereby causing ball nut 34 to linearly move in the reverse direction. Control shaft 15 with eccentric control cam 16 is rotated in a clockwise direction so that central axis P1 of eccentric control cam 16 is further downwardly moved to the positions as shown in FIGS. 13 and 14. This causes rocker arm 114 to be pivotally moved closer to drive shaft 3, so that push rods 120, 121 at bifurcated end portions 14*d*, 14*d* urge contact surfaces 113A, 113A of cam lobes 113, 113 of rocker cams 105, 105 to move downwardly. Each of rocker cams 105, 105 as a whole is pivotally rotated in the clockwise direction by a predetermined amount.

In this condition, when drive cam 4 is rotated such that the cam nose lifts the one end portion 14*c* of rocker arm 114 through roller 18, the lift motion of the one end portion 14*c* is transmitted to rocker cams 105, 105 through push rods 120, 121 to thereby cause rocker cams 105, 105 to be pivotally moved in the clockwise direction and placed in the maximum pivotal position as shown in FIG. 14. During the pivotal motion of rocker cams 105, 105, the contact points between rocker cams 105, 105 and driven rollers 40, 40 on swing arms 37, 37 are displaced from the base-circle surfaces to the maximum-lift surfaces via the ramp surfaces and the small-lift surfaces of cam surfaces 113*b*, 113*b* of rocker cams 105, 105. Therefore, the lift of intake valves 2, 2 becomes maximum.

Accordingly, in the high-speed range of the engine, each of driven rollers 40, 40 on swing arms 37, 37 is reciprocatively rolled over the region of cam surface 113*b* of rocker cam 105 which extends between the base-circle surface and the maximum-lift surface via the ramp surface and the small-lift surface. In this condition, the lift of intake valves 2, 2 is varied to the maximum as indicated by characteristic curve L2 in FIG. 15. This results in advancement in an opening timing of intake valves 2, 2 and retardation in a closing of timing of intake valves 2, 2, thereby serving for enhancing charging efficiency of intake air and ensuring sufficient engine power output.

The second embodiment as described above can achieve the following effects. First, since the pivotal motion of rocker arm 114 is transmitted to rocker cams 105, 105 through push rods 120, 121 which have pivot end portions 120*a*, 120*b*, 121*a*, 121*b* at the opposite ends thereof, the construction of the variable valve operating apparatus of the second embodiment can be simplified, and the number of parts can be reduced. This serves for saving the production cost and enhancing freedom of layout of the parts. Further, in this embodiment, the downward pivotal motion of rocker cams 105, 105 can be effectively attained using push rods 120, 121, as compared to a case in which the rocker arm is configured and arranged to directly push the rocker cams downwardly. This serves for increasing the maximum valve lift.

Further, push rods 120, 121 are upwardly biased by the spring force of torsion springs 123, 123 through rocker cams 105, 105 irrespective of the rotational position, i.e., the rotational phase, of drive cam 4. This causes pivot end portions 120*a*, 120*b*, 121*a*, 121*b* of push rods 120, 121 to be suitably in press-contact with recessed portions 113*a*, 113*a* of cam lobes 113, 113 of rocker cams 105, 105 and recessed portions 14*e*, 14*e* of bifurcated end portions 14*d*, 14*d* of rocker arm 114 and retained thereat. As a result, push rods 120, 121 can be prevented from falling off from cam lobes 113, 113 of rocker cams 105, 105 and bifurcated end portions 14*d*, 14*d* of rocker arm 114 during the operation of the variable valve operating apparatus. In addition, occurrence of noise caused due to interference between pivot end portions 120*a*, 121*a* of push rods 120, 121 and cam lobes 113, 113 of rocker cams 105, 105 and between pivot end portions 120*b*, 121*b* of push rods 120, 121 and bifurcated end portions 14*d*, 14*d* of rocker arm 114 can be suppressed, and a smooth operation of the variable valve operating apparatus can be achieved.

Further, a distance between rocker cams 105, 105 and bifurcated end portions 14*d*, 14*d* of rocker arm 114 can be optionally changed by selectively using push rods 120, 121 having different lengths. This attains free adjustment of the lift of intake valves 2, 2.

Even when dispersion in valve lift between the engine cylinders is caused upon assembling, the dispersion can be eliminated by replacing push rods 120, 121 with another ones different in length. Further, it is required to set a fine gap between a valve head of each of intake valves 2, 2 and a circumferential periphery of each of intake ports in cylinder head 1 which is caused when the valve lift is controlled to a small lift amount. Upon setting the fine gap, accuracy of the adjustment of the valve lift can be enhanced by selectively using push rods 120, 121 which have different lengths from each other. This serves for improving fuel economy and stability of the engine operation during idling.

Here, when intake valves 2, 2 are operated by single drive cam 4 through single rocker arm 114, a difference in valve lift between intake valves 2, 2 will occur, and it is difficult to eliminate the difference in valve lift between intake valves 2, 2. However, in this embodiment, the difference in valve lift can be eliminated by replacing one of push rods 120, 121 with another having a length depending on the difference in valve lift. Further, by using single drive cam 4 and single rocker arm 114, the construction of the variable valve operating apparatus of this embodiment can be simplified. Furthermore, rocker arm 114 has the symmetrical shape as described above, so that rocker arm 114 can be prevented from coming into unbalanced attitude and a tilted state in the axial direction. This results in enhanced stability of intake valves 2, 2.

Figure 16:
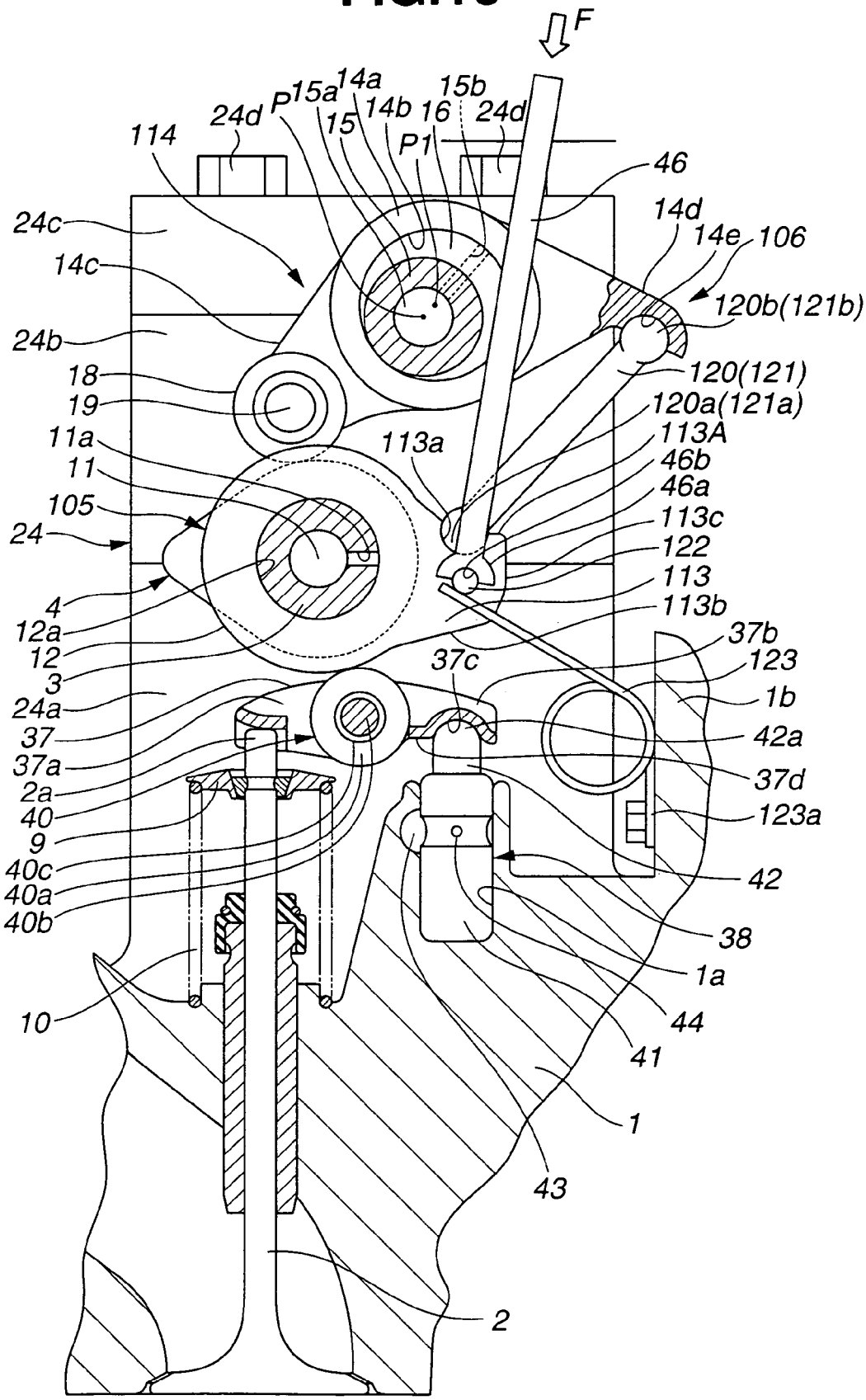
FIG. 16 is an explanatory diagram showing an operation of replacing push rods with a tool in the second embodiment of the variable valve operating apparatus.

FIG. 16 illustrates an operation of replacing one or both push rods 120, 121 with new one or ones, using elongated tool 46. As shown in FIG. 16, tool 46 has pin pressing portion 46*a* on one end portion thereof. Pin pressing portion 46*a* is formed with recess 46*b* that is configured to be engageable with an outer circumferential surface of each of retainer pins 122, 122 on rocker cams 105, 105. The replacing operation of push rods 120, 121 now is explained. First, load F is applied to an opposite end portion of tool 46 from an upward direction such that recess 46*b* of pin pressing portion 46*a* is pressed against the outer circumferential surface of retainer pin 122. Rocker cam 105 is rotated in the clockwise direction against the spring force of torsion spring 123 such that cam nose 113*c* is downwardly displaced and pivot end portion 120*a*, 121*a* of push rod 120, 121 is disengaged from recessed portion 113*a* of cam lobe 113. Thus, one or both of push rods 120, 121 can be removed.

Subsequently, opposite pivot end portions of a new push rod are engaged with recessed portion 113*a* of cam lobe 13 of rocker cam 105 and recessed portion 14*e* of bifurcated end portion 14*d* of rocker arm 114. Thus, one or both of push rods 120, 121 can be replaced with new one or ones. An operation of assembling push rods 120, 121 to rocker cams 105, 105 and rocker arm 114 is conducted using tool 46 in the same manner as described above.

In the second embodiment, the replacing operation of push rods 120, 121 is readily completed by using tool 46 and retainer pins 122. This results in facilitating adjustment of the valve lift. In addition, the assembling and disassembling operations of push rods 120, 121 can be facilitated.

Further, in the second embodiment, when the lift of intake valves 2, 2 is controlled to a small lift amount, the reaction forces of valve springs 10, 10 which are exerted on rocker cams 105, 105 become small. Accordingly, if push rods 120, 121 are replaced or assembled to rocker cams 105, 105 and rocker arm 114 upon the small valve lift control, the replacing or assembling operation of push rods 120, 121 can be facilitated.

If the replacing operation of push rods 120, 121 is carried out under condition that intake valves 2, 2 are in the closed positions in which rocker cams 105, 105 are free from the reaction forces of valve springs 10, 10, only the spring forces of torsion springs 123, 123 act on rocker cams 105, 105 through retainer pins 122, 122. In this case, load F becomes reduced, and the replacing operation of push rods 120, 121 can be further facilitated.

Further, cam lobes 113 of rocker cams 105, 105 are held between pivot end portions 120*a*, 121*a* of push rods 120, 121 and the end portions of torsion springs 123, 123 which are in contact with retainer pins 122, 122. With this arrangement, the biasing forces of torsion springs 123, 123 and the pressing forces of push rods 120, 121 which are applied to rocker cams 105, 105 are cancelled to thereby cause no load that is applied to drive shaft 3 through rocker cams 105, 105. This results in increase in strength of drive shaft 3 and reduction of frictional loss thereof to thereby serve for improving fuel economy.

Further, since rocker cams 105, 105 are supported between push rods 120, 121 and swing arms 37, 37, the pressing forces applied to rocker cams 105, 105 via push rods 120, 121 and the reaction forces of valve springs 10, 10 which exert on rocker cams 105, 105 via swing arms 37, 37 are cancelled. Therefore, the load applied to drive shaft 3 through rocker cams 105, 105 can be reduced. This serves for suppressing increase in frictional loss of drive shaft 3 and improving the durability.

Figure 17:
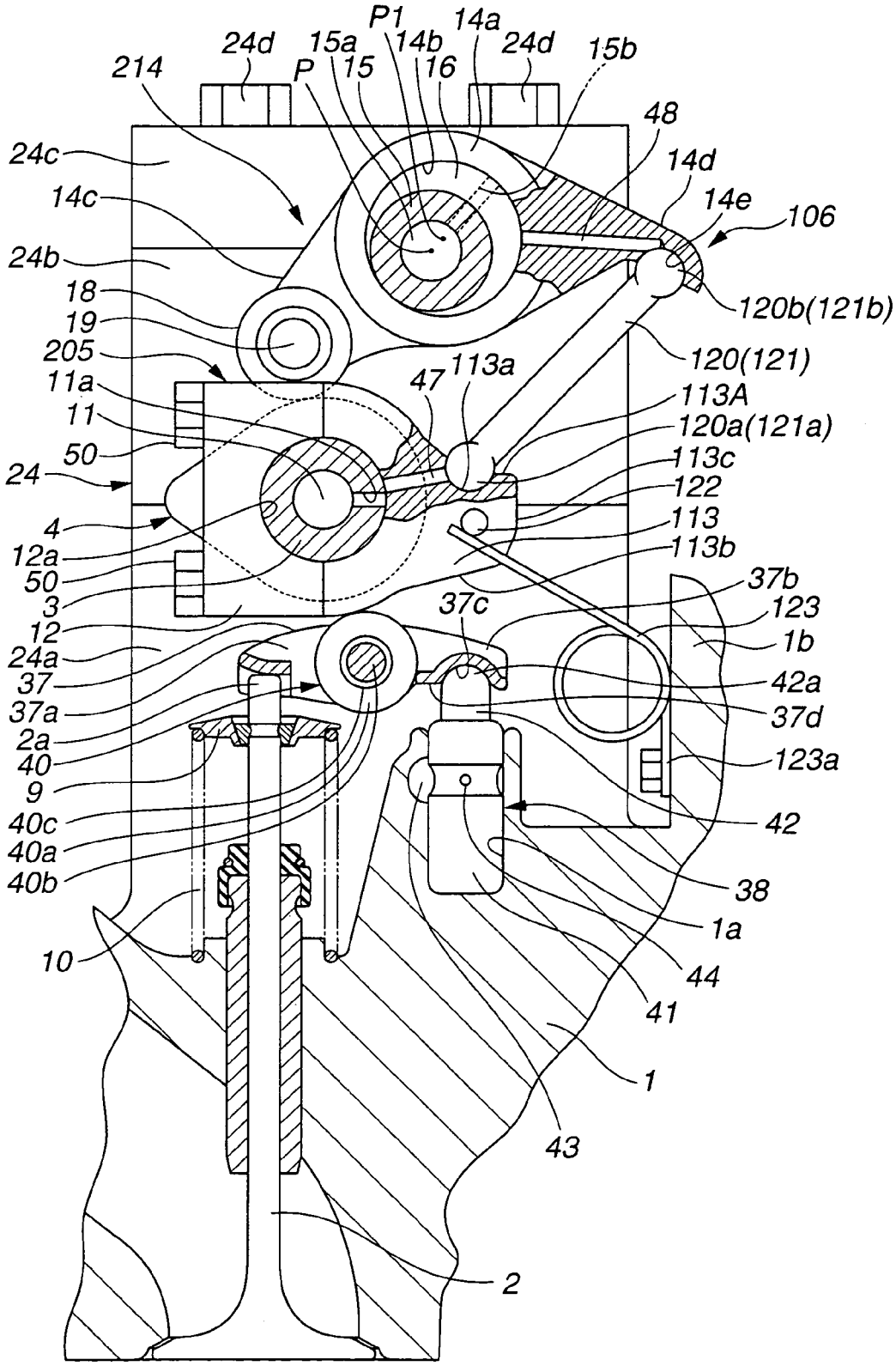
FIG. 17 is a vertical cross-section of a third embodiment of the variable valve operating apparatus according to the present invention.
Figure 18:
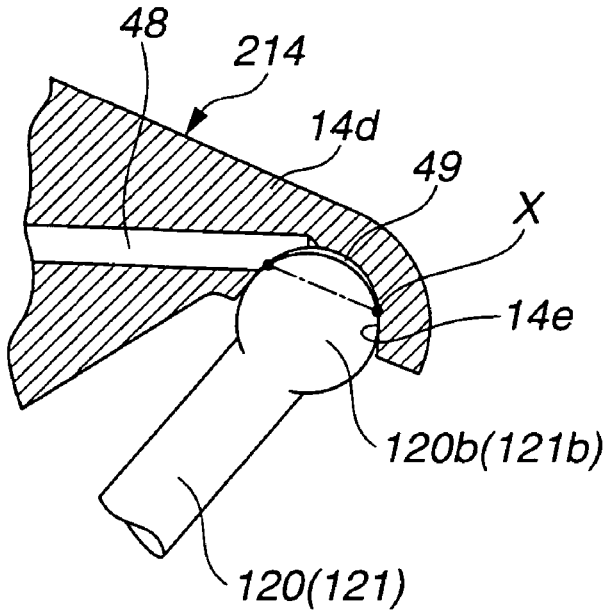
FIG. 18 is an enlarged view of an essential part of the third embodiment of the variable valve operating apparatus.

Referring to FIGS. 17 and 18, there is shown a third embodiment of the variable valve operating apparatus, which differs from the second embodiment in construction and arrangement of the rocker cams and provision of lubrication passages in the rocker cams and the rocker arm. Like reference numerals denote like parts, and therefore, detailed explanations therefor are omitted. As illustrated in FIG. 17, each of rocker cams 205, 205 includes base portion 12 divided into two parts and coupled with each other by means of a pair of bolts 50, 50. With this construction, when rocker cams 205, 205 are assembled to drive shaft 3, an operation of assembling each of rocker cams 205, 205 to drive shaft 3 can be considerably facilitated without fitting rocker cam 205 onto drive shaft 3 through central bore 12*a* in the axial direction of drive shaft 3. The assembling operation of rocker cams 205, 205 can be considerably facilitated.

Each of rocker cams 205, 205 includes oil passage 47 for fluid communication with oil hole 11*a* of drive shaft 3. Oil passage 47 has one end open to the inner circumferential surface defining central bore 12*a* of base portion 12 of rocker cam 205 and an opposite end open to a semispherical bottom surface of each of recessed portions 113*a*, 113*a* of cam lobe 13 of rocker cam 205. When drive shaft 3 is placed in a predetermined rotational position, oil passage 47 is communicated with oil hole 11*a*. In addition, rocker arm 214 includes oil passage 48 for fluid communication with oil passage 15*b* that extends through eccentric control cam 16 and control shaft 15. Oil passage 48 has one end open to the inner circumferential surface defining support through-bore 14*b* of rocker arm 214 and an opposite end open to a semispherical bottom surface of each of recessed portions 14*e*, 14*e* of bifurcated end portions 14*d*, 14*d* of rocker arm 214. When control shaft 15 with eccentric control cam 16 is placed in a predetermined rotational position, oil passage 48 is communicated with oil passage 15*b*.

As illustrated in FIG. 18, oil retention portion 49 is defined between the spherical outer surface of each of pivot end portions 120*b*, 121*b* of push rods 120, 121 and the semispherical bottom surface of each of recessed portions 14*e*, 14*e* of bifurcated end portions 14*d*, 14*d* of rocker arm 214. Oil retention portion 49 is communicated with oil passage 48 in rocker arm 214. There is an annular contact portion as indicated by phantom line X in FIG. 18, between the spherical outer surface of each of pivot end portions 120*b*, 121*b* and the bottom surface of each of recessed portions 14*e*, 14*e* of bifurcated end portions 14*d*, 14*d*. At the contact portion X, pivot end portions 120*b*, 121*b* are in line contact with recessed portions 14*e*, 14*e*.

In this embodiment, the lubricating oil flowing from oil passage 11 in drive shaft 3 into oil passage 47 via oil hole 11*a* is supplied to each of recessed portions 113*a*, 113*a* of cam lobes 13 of rocker cams 205, 205. On the other hand, the lubricating oil flowing from oil introducing passage 15*a* in control shaft 15 into oil passage 48 via oil passage 15*b* is supplied to each of recessed portions 14*e*, 14*e* of bifurcated end portions 14*d*, 14*d* of rocker arm 214. Accordingly, the lubrication between the bottom surface of each of recessed portions 113*a*, 113*a* of rocker cams 205, 205 and the outer surface of each of pivot end portions 120*a*, 121*a* of push rods 120, 121 and the lubrication between the bottom surface of each of recessed portions 14*e*, 14*e* of bifurcated end portions 14*d*, 14*d* and the outer surface of each of pivot end portions 120*b*, 121*b* of push rods 120, 121 can be effectively performed. As a result, smooth sliding motions of rocker cams 205, 205 and rocker arm 214 with respect to push rods 120, 121 can be attained. Further, occurrence of wear between recessed portions 113*a*, 113*a* and pivot end portions 120*a*, 121*a* and between recessed portions 14*e*, 14*e* and pivot end portions 120*b*, 121*b* can be prevented.

In particular, with the provision of oil retention portion 49, an oil film can be formed between the bottom surface of each of recessed portions 14*e*, 14*e* and the outer surface of each of pivot end portions 120*b*, 121*b*. Owing to the oil film formation, the lubrication between the bottom surface of each of recessed portions 14*e*, 14*e* of bifurcated end portions 14*d*, 14*d* of rocker arm 214 and the outer surface of each of pivot end portions 120*b*, 121*b* of push rods 120, 121 can be further enhanced. Further, pivot end portions 120*b*, 121*b* are slidable in line contact with recessed portions 14*e*, 14*e*, thereby resulting in improved oil retention in oil retention portion 49 and further enhanced lubrication between the bottom surface of each of recessed portions 14*e*, 14*e* of bifurcated end portions 14*d*, 14*d* of rocker arm 214 and the outer surface of each of pivot end portions 120*b*, 121*b* of push rods 120, 121.

Figure 19:
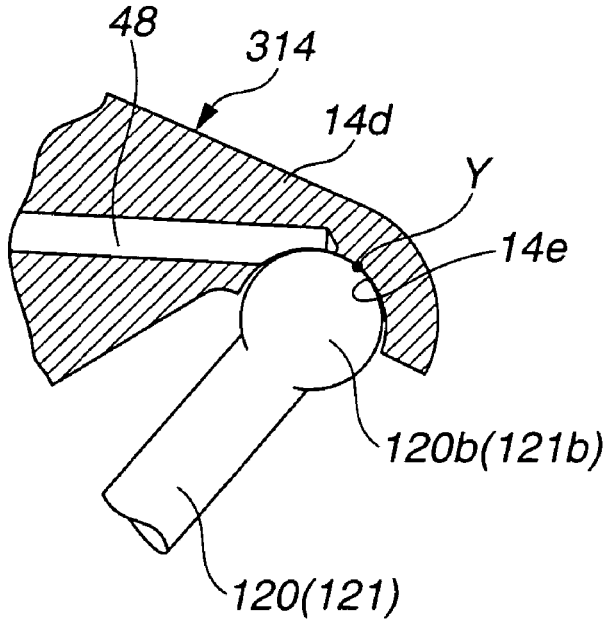
FIG. 19 is a view similar to FIG. 18, but showing a fourth embodiment of the variable valve operating apparatus according to the present invention.

Referring to FIG. 19, there is shown a fourth embodiment of the variable valve operating apparatus, which differs from the third embodiment in configuration of the recessed portions of the rocker arm. As illustrated in FIG. 19, rocker arm 314 has upsized recessed portion 14*e* on each of bifurcated end portions 14*d*, 14*d*. Recessed portion 14*e* has an inner diameter which is slightly larger than an outer diameter of each of pivot end portions 120*b*, 121*b* of push rods 120, 121 such that pivot end portion 120*b*, 121*b* is in point contact with the bottom surface of recessed portion 14*e* as indicated at Y in FIG. 19. Therefore, each of pivot end portions 120*b*, 121*b* is slidable in point contact with the bottom surface of recessed portion 14*e*. This results in reduction of slide-friction resistance between pivot end portions 120*b*, 121*b* and recessed portions 14*e*, 14*e* to thereby achieve the smooth slide motions thereof and provide improved fuel economy.

Figure 20:
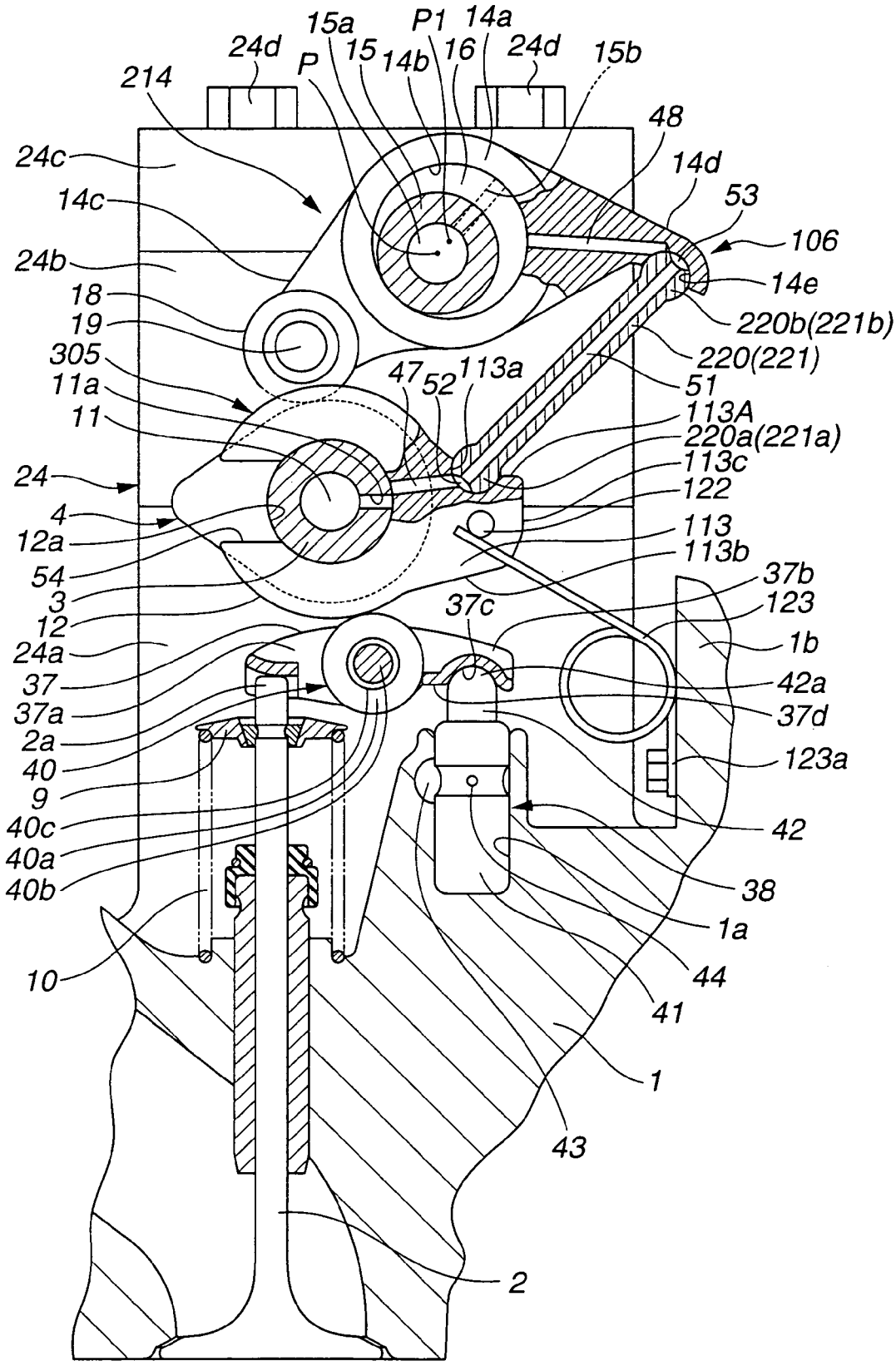
FIG. 20 is a vertical cross-section of a fifth embodiment of the variable valve operating apparatus according to the present invention.

Referring to FIG. 20, there is shown a fifth embodiment of the variable valve operating apparatus, which differs from the third embodiment in provision of an oil passage in the push rods and oil grooves in the pivot end portions of the push rods and construction of the rocker cams. As illustrated in FIG. 20, push rods 220, 221 include axial oil passage 51, oil groove 52 formed on a tip end surface of pivot end portions 220*a*, 221*a*, and oil groove 53 formed on a tip end surface of pivot end portions 220*b*, 221*b*. Oil passage 51 has opposite ends open to oil grooves 52 and 53. Oil groove 52 is communicated with oil passage 47 formed in rocker cams 305, 305. Oil groove 53 is communicated with oil passage 48 formed in rocker arm 214. The lubricating oil flowing from oil passage 48 into oil passage 51 in each of push rods 220, 221 via oil groove 53 is supplied to each of recessed portions 113*a*, 113*a* of cam lobes 113 of rocker cams 305, 305 and each of pivot end portions 220*a*, 221*a* of push rods 220, 221 via oil groove 52.

Accordingly, the lubrication between the bottom surface of each of recessed portions 113*a*, 113*a* and the outer surface of each of pivot end portions 220*a*, 221*a* can be positively performed and thereby further enhanced. The lubricating oil flowing from oil groove 52 is introduced between the inner circumferential surface of each of rocker cams 305, 305 and the outer circumferential surface of drive shaft 3 via oil passage 47, and lubricates the mutually sliding portions thereof.

Each of rocker cams 305, 305 includes cutout 54 that is formed on base portion 12 on an opposite side of cam lobe 113 and communicated with central bore 12*a*. Cutout 54 is defined by opposed planar surfaces substantially parallel to each other. Upon assembling, rocker cam 305 is assembled onto drive shaft 3 by fitting the opposed planar surfaces of cutout 54 onto opposed planar surfaces of a cutout, not shown, which is formed on the outer circumferential surface of drive shaft 3. With the provision of cutout 54 of rocker cam 305 and the corresponding cutout of drive shaft 3, rocker cam 305 can be assembled in a radial direction of drive shaft 3. This results in facilitating the assembling operation of rocker cams 305, 305, and results in reduction in weight of rocker cams 305, 305 and inertial mass.

Further, in this embodiment, the lubricating oil is supplied to the mutually sliding portions of drive shaft 3 and rocker cams 305, 305 via oil passage 47 in rocker cams 305, 305, without flowing from oil passage 11 via oil hole 11*a* in drive shaft 3. Accordingly, even when oil hole 11*a* and cutout 54 are aligned with each other during the rotational motion of drive shaft 3, the lubricating oil can be prevented from being ejected into the air through oil hole 11*a* and cutout 54 in drive shaft 3. This suppresses supply of an excessive amount of the lubricating oil.

Figure 21:
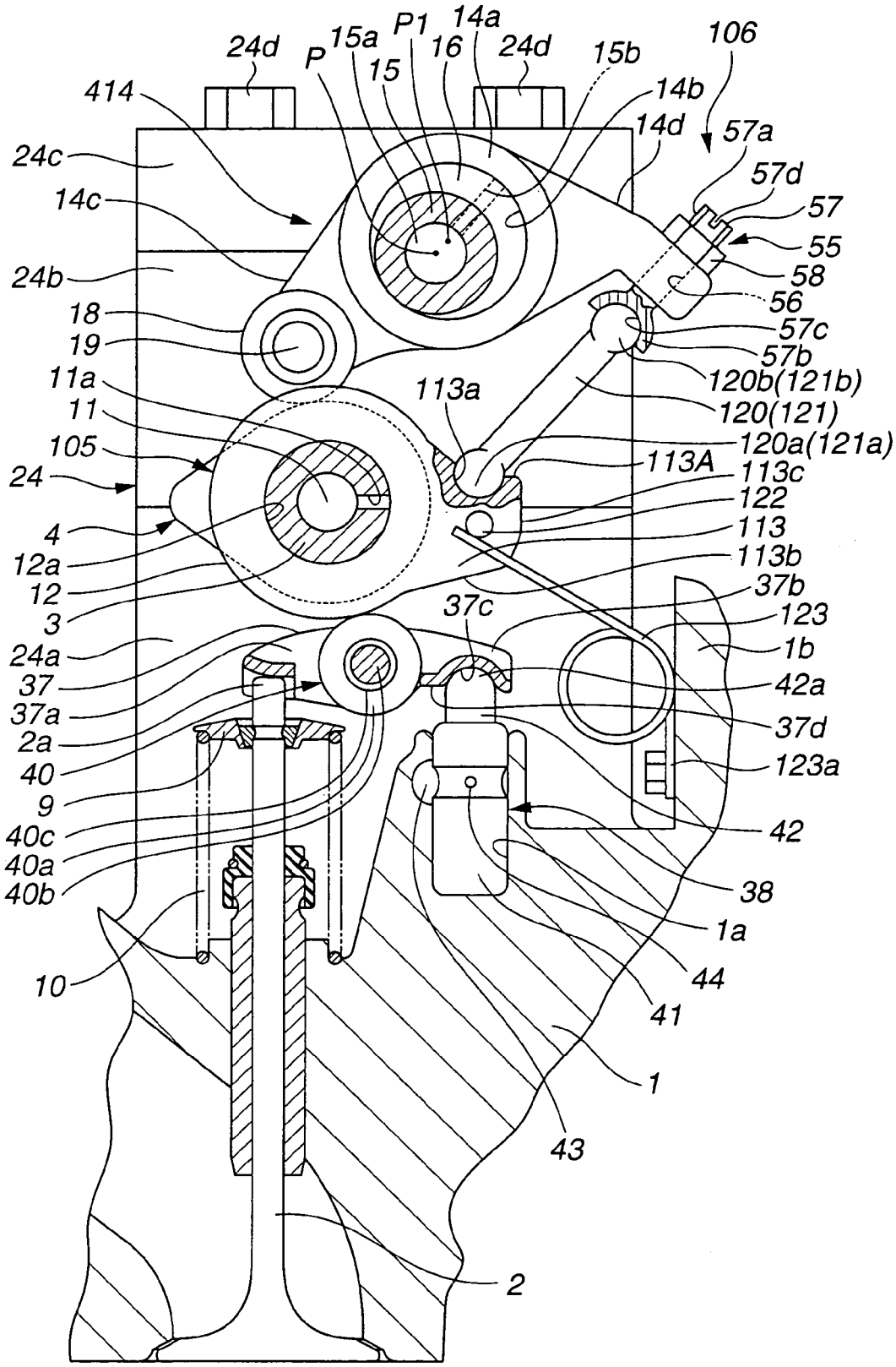
FIG. 21 is a view similar to FIG. 20, but showing a sixth embodiment of the variable valve operating apparatus according to the present invention.

Referring to FIG. 21, there is shown a sixth embodiment of the variable valve operating apparatus, which differs from the second embodiment in provision of an adjustor assembly for adjusting the axial positions of the pivot end portions of the push rods. As illustrated in FIG. 21, adjustor assembly 55 is disposed between bifurcated end portions 14*d*, 14*d* of rocker arm 414 and pivot end portions 120*b*, 121*b* of push rods 120, 121. Adjustor assembly 55 includes tapped hole 56 extending through each of bifurcated end portions 14*d*, 14*d*, adjust rod 57 screwed into tapped hole 56, and lock nut 58 screwed onto a tip end portion of adjust rod 57. Adjust rod 57 has threads 57*a* on an outer circumferential surface and groove 57*d* on a top surface of adjust rod 57. Adjust rod 57 further has cup-shaped retainer portion 57*b* on a lower end portion thereof. Cup-shaped retainer portion 57*b* has spherical recess 57*c* engaged with each of pivot end portions 120*b*, 121*b* of push rods 120, 121.

Thus-constructed adjustor assembly 55 is operated as follows. Lock nut 58 is unscrewed, and then a tool such as a screwdriver is engaged in groove 57*d* and rotated in a clockwise or counterclockwise direction to thereby move adjust rod 57 in the axial direction and vary the axial position of retainer portion 57*b*. When retainer portion 57*b* is placed in a desired axial position, lock nut 58 is screwed to fix retainer portion 57*b* in the desired axial position. As a result, the axial positions of pivot end portions 120*a*, 121*a*, 120*b*, 121*b* of push rods 120, 121 are adjusted.

In this embodiment using adjustor assembly 55, the pivotal position of rocker cams 105, 105 can be adjusted without replacing push rods 120, 121 with new ones having different lengths, so that the lift of intake valves 2, 2 can be fine-controlled. Accordingly, the number of replacement of push rods 120, 121 can be reduced, or the replacing operation thereof can be omitted.

Figure 22:
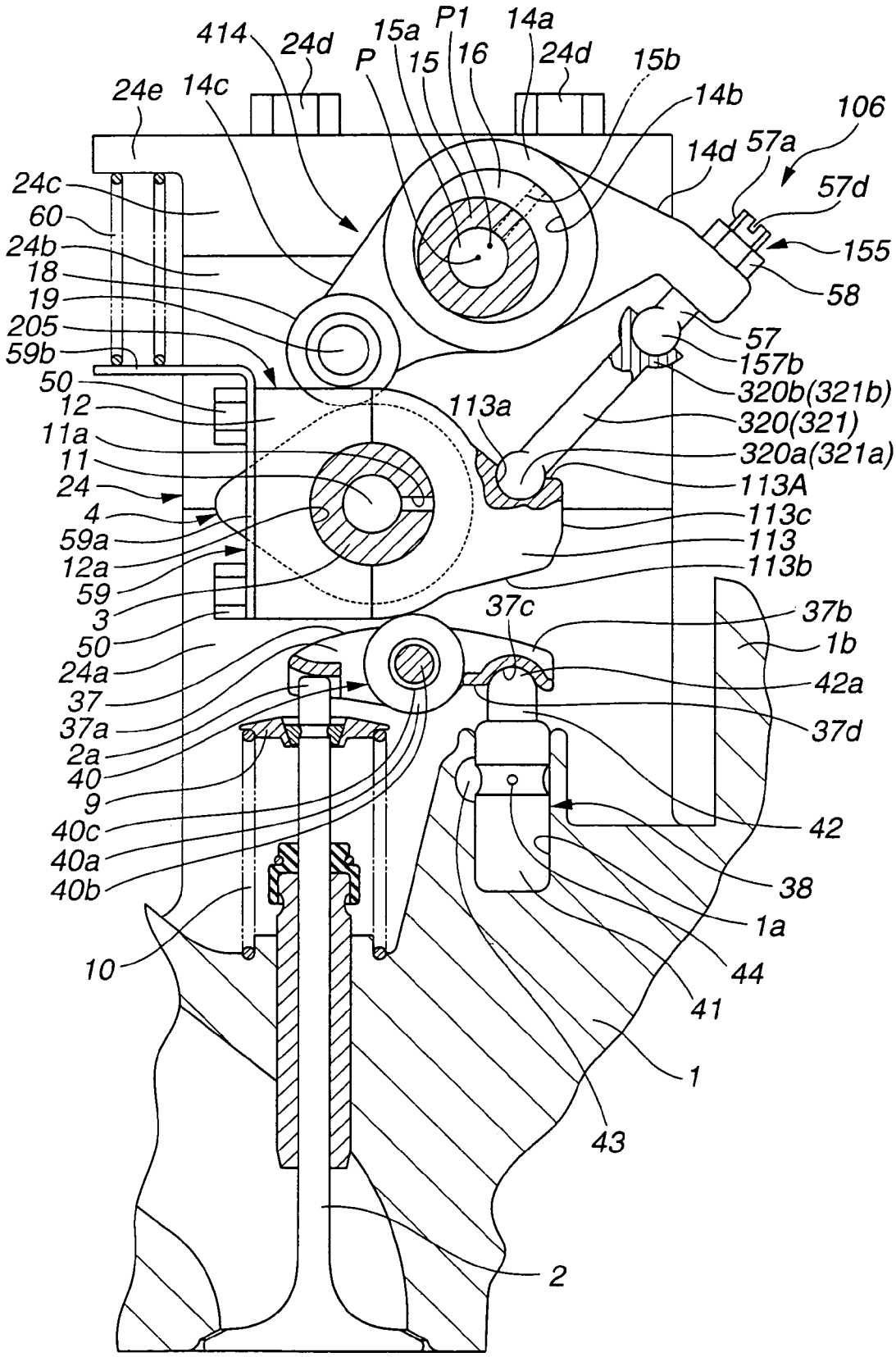
FIG. 22 is a view similar to FIG. 21, but showing a seventh embodiment of the variable valve operating apparatus according to the present invention.

Referring to FIG. 22, there is shown a seventh embodiment of the variable valve operating apparatus. This embodiment differs from the sixth embodiment in construction of the adjust rods of the adjustor assembly and the push rods and arrangement of the biasing member for the rocker cams. As illustrated in FIG. 22, adjustor assembly 155 includes adjust rod 57 that has spherical pivot end portion 157*b*. Push rods 320, 321 include generally spherical-shaped pivot end portions 320*a*, 321*a* at lower ends thereof and cup-shaped retainer portions 320*b*, 321*b* on upper ends thereof. Pivot end portions 320*a*, 321*a* are engaged with recessed portions 113*a*, 113*a* of cam lobes 113 of rocker cams 205, 205. Cup-shaped retainer portions 320*b*, 321*b* have spherical recesses engaged with pivot end portion 157*b* of adjust rod 57. This embodiment can perform the effect of fine-control of the valve live as explained in the sixth embodiment.

Further, each of rocker cams 205, 205 includes base portion 12 divided into two parts as explained in the third embodiment. As shown in FIG. 22, one of the two parts of base portion 12 has a rectangular shape, and the other thereof with cam lobe 113 has a generally trapezoidal shape. Single generally L-shaped bracket 59 is provided in common to rocker cams 205, 205. Bracket 59 is mounted to the rectangular parts of base portions 12, 12 of respective rocker cams 205, 205. Specifically, bracket 59 includes vertically extending base 59*a* fixed to outer surfaces of the rectangular parts of base portions 12, 12 by means of bolts 50, 50, and free end portion 59*b* connected with base 59*a* and extending substantially perpendicular thereto. Coil spring 60 is installed between free end portion 59*b* of bracket 59 and retainer 24*e* that laterally projects from an upper end portion of bearing bracket 24*c*. Rocker cams 205, 205 are biased by the spring force of coil spring 60 to rotate in the counter-clockwise direction in FIG. 22.

This embodiment can perform the same effects as those of the sixth embodiment. Further, in this embodiment, upon assembling each of rocker cams 205, 205 to drive shaft 3, the two parts of base portion 12 of rocker cam 205 are coupled together, and at the same time, bracket 59 is fixed to the rectangular parts of base portion 12 of rocker cam 205 by means of bolts 50, 50. This serves for cost-saving and improving freedom of layout of the parts in the vicinity of rocker cam 205.

The arrangement of the drive cam and the eccentric control cam is not limited to the above embodiments. The drive cam may be arranged at a central portion of the rocker arm, and the eccentric control cam may be arranged on a side of the one end portion of the rocker arm.

This application is based on prior Japanese Patent Application Nos. 2004-345069 filed on Nov. 30, 2004 and 2005-17719 filed on Jan. 26, 2005. The entire contents of the Japanese Patent Application Nos. 2004-345069 and 2005-17719 are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A variable valve operating apparatus for variably operating an engine valve of an internal combustion engine, the variable valve operating apparatus comprising:

a drive cam configured to receive input torque from a crankshaft of the engine;

a rocker cam pivotally supported on a first pivot;

a lift varying mechanism operative to change a pivotal position of the rocker cam to vary a valve lift of the engine valve, while transmitting the input torque from the drive cam to the rocker cam;

a swing arm including one end portion at which the swing arm is pivotally supported on a second pivot and the other end portion contacted with the engine valve;

a hollow space defined between the one end portion of the swing arm and the other end portion thereof; and a driven roller rotatably disposed within the hollow space of the swing arm and contacted with a cam surface of the rocker cam, wherein when the valve lift of the engine valve is a predetermined lift amount or more, a contact point between the driven roller and the rocker cam is located in the hollow space of the swing arm.

2. The variable valve operating apparatus as claimed in claim 1, wherein the lift varying mechanism comprises motion transmission members transmitting the input torque from the drive cam to the rocker cam, and the rocker cam is interposed between the motion transmission members and the driven roller.

3. The variable valve operating apparatus as claimed in claim 1, wherein the rocker cam comprises a plurality of rocker cam members corresponding to a plurality of engine valves, and the lift varying mechanism comprises a symmetrical-branched rocker arm including one end portion at which one of the motion transmission members is disposed, and the other end portion at which the remaining motion transmission members are disposed.

4. The variable valve operating apparatus as claimed in claim 1, further comprising a drive shaft on which the drive cam is disposed and integrally formed therewith, the rocker cam being pivotally supported on the drive shaft.

5. The variable valve operating apparatus as claimed in claim 2, wherein the motion transmission members are in the form of rollers.

6. The variable valve operating apparatus as claimed in claim 4, further comprising a spacer disposed between the drive cam and the rocker cam.

7. The variable valve operating apparatus as claimed in claim 1, wherein the lift varying mechanism comprises:

a control shaft having an eccentric control cam on an outer periphery thereof;

a rocker arm pivotally fitted onto the eccentric control cam of the control shaft;

a first motion transmission member disposed at one end portion of the rocker arm and contacted with the drive cam; and a second motion transmission member disposed at the other end portion of the rocker arm and contacted with the rocker cam;

wherein the control shaft is rotatably operated to vary a pivotal position of the rocker arm to cause the variation in the valve lift of the engine valve.

8. The variable valve operating apparatus as claimed in claim 7, wherein the control shaft is formed with an axially extending oil introducing passage to which lubricating oil is supplied and a first oil hole communicating the oil introducing passage, and the eccentric control cam is formed with a second oil hole cooperating with the first oil hole to form an oil passage through which the lubricating oil is fed to between an outer circumferential surface of the eccentric control cam and an inner circumferential surface of the rocker arm.

9. The variable valve operating apparatus as claimed in claim 7, further comprising an actuator producing a rotary motion, a nut converting the rotary motion of the actuator to a linear motion, and a link mechanically connecting the nut with the control shaft and converting the linear motion of the nut to the rotary motion of the control shaft.

10. The variable valve operating apparatus as claimed in claim 9, wherein the actuator comprises an electric motor.

11. The variable valve operating apparatus as claimed in claim 1, wherein the rocker cam comprises two rocker cam members between which the drive cam is disposed, the lift varying mechanism comprising two motion transmission members transmitting the input torque from the drive cam to the two rocker cam members and operating the two rocker cam members in synchronized relation to each other.

12. The variable valve operating apparatus as claimed in claim 1, wherein the drive cam has a rotation axis located in a position upwardly spaced from an axis of the engine valve.

13. The variable valve operating apparatus as claimed in claim 1, wherein when the valve lift of the engine valve is a predetermined lift amount or more, a contact surface of the rocker cam which is contacted with the lift varying mechanism is disposed in the hollow space of the swing arm.

14. The variable valve operating apparatus as claimed in claim 1, wherein the swing arm has a bottom surface that defines the hollow space, the rocker cam comprising a cam nose which is opposed to the bottom surface of the swing arm with a clearance when the valve lift of the engine valve is a predetermined lift amount or more and the pivotal motion of the rocker cam is a maximum.

15. The variable valve operating apparatus as claimed in claim 1, wherein the first pivot of the rocker cam is formed with an axial oil passage to which lubricating oil is supplied and an oil hole communicating the axial oil passage, the lubricating oil being fed to a rotational slide portion between the first pivot and the rocker cam via the axial oil passage and the oil hole.

16. The variable valve operating apparatus as claimed in claim 1, further comprising a spring biasing the rocker cam such that a cam nose is pivotally moved toward the lift varying mechanism.

17. The variable valve operating apparatus as claimed in claim 1, wherein the second pivot is provided in the form of a lash adjuster.

18. A variable valve operating apparatus for variably operating an engine valve of an internal combustion engine, the variable valve operating apparatus comprising:

a drive cam configured to receive input torque from a crankshaft of the engine;

a swing arm including one end portion at which the swing arm is pivotally supported on a first pivot and the other end portion contacted with the engine valve;

a hollow space defined between the one end portion of the swing arm and the other end portion thereof;

a rocker cam pivotally supported on a second pivot such that a cam nose thereof is located in the hollow space when the valve lift of the engine valve is a predetermined lift amount or more;

a lift varying mechanism operative to change a pivotal position of the rocker cam to vary a valve lift of the engine valve, while transmitting the input torque from the drive cam to the rocker cam; and a driven roller rotatably disposed within the hollow space in the swing arm and contacted with a cam surface of the rocker cam.

19. A variable valve operating apparatus for variably operating an engine valve of an internal combustion engine, the variable valve operating apparatus comprising:

a drive cam configured to receive input torque from a crankshaft of the engine;

a rocker cam pivotally supported on a first pivot, the rocker cam having two surfaces opposed to each other in a direction of the pivotal motion of the rocker cam;

a rocker member converting a rotational motion of the drive cam to a pivotal motion;

a first motion transmission member transmitting the pivotal motion of the rocker member to the rocker cam, the first motion transmission member being rotatably disposed on the rocker member and contacted with one of the two surfaces of the rocker cam;

a control section for varying the pivotal motion of the rocker member to vary lift of the engine valve;

a swing arm including one end portion at which the swing arm is pivotally supported on a second pivot and the other end portion contacted with the engine valve; and a second motion transmission member transmitting the pivotal motion of the rocker cam to the engine valve, the second motion transmission member being rotatably disposed on the swing arm and contacted with the other of the two surfaces of the rocker cam.

20. The variable valve operating apparatus as claimed in claim 19, wherein the one of the two surfaces of the rocker cam is formed into a planar surface.

* * * * *

UNITED STATES PATENT AND TRADEMARK OFFICE

CERTIFICATE OF CORRECTION

PATENT NO. : 7,305,946 B2
APPLICATION NO. : 11/248150
DATED : December 11, 2007
INVENTOR(S) : Nakamura et al.

It is certified that error appears in the above-identified patent and that said Letters Patent is hereby corrected as shown below:

On the cover page,

[*] Notice: Subject to any disclaimer, the term of this patent is extended or adjusted under 35 USC 154(b) by 56 days Delete the phrase "by 56 days" and insert -- by 76 days --

Signed and Sealed this

Tenth Day of March, 2009

John Doll

JOHN DOLL
*Acting Director of the United States Patent and Trademark Office*